US005921004A

United States Patent [19]

Lyden

[11] Patent Number: 5,921,004

[45] Date of Patent: Jul. 13, 1999

[54] FOOTWEAR WITH STABILIZERS

[75] Inventor: Robert M. Lyden, Aloha, Oreg.

[73] Assignee: Nike, Inc., Beaverton, Oreg.

[21] Appl. No.: 08/893,506

[22] Filed: Jul. 11, 1997

Related U.S. Application Data

[63] Continuation-in-part of application No. 08/476,104, Jun. 7, 1995, abandoned.

[51] Int. Cl.[6] ..... A43B 13/00

[52] U.S. Cl. ..... 36/25 R; 36/114; 36/78

[58] Field of Search ..... 36/28, 78, 77 R, 36/17 R, 114, 25 R

[56] References Cited

U.S. PATENT DOCUMENTS

| | | |
|---|---|---|
| 2,401,089 | 5/1946 | Manahan . |
| 2,471,696 | 5/1949 | Milchen . |
| 3,029,823 | 4/1962 | Zerkowitz . |
| 3,083,477 | 4/1963 | Diamant . |
| 3,217,345 | 11/1965 | Snitzer . |
| 3,793,750 | 2/1974 | Bowerman . |
| 3,997,984 | 12/1976 | Hayward . |
| 4,043,058 | 8/1977 | Hollister et al. . |

(List continued on next page.)

FOREIGN PATENT DOCUMENTS 549 962 A1 12/1992 European Pat. Off. .

OTHER PUBLICATIONS

The Adidas "SL72 and SL76", as illustrated in an advertisement in Runners World Magazine, Jan. 1979.

The Adidas "Marathon Trainer", as illustrated in an advertisement in Runners World Magazine, Jul. 1980.

The Adidas "Adistar Sprint", as illustrated in an Addidas brochure.

The Tigar "Spartan B", as illustrated in Runners World Magazine, 1977.

The Nike "Zoom" Sprint, as illustrated in a Nike 1995 Catalog.

The E.B. "Road Runner", as illustrated in Runners World Magazine, Oct. 1975.

"The Complete Handbook of Athletic Footwear"; by Melvyn P. Cheskin, p. 152.

"Torsional Movement of the Foot During Landing", A. Stacoff, X. Kaelin, E. Stussi and B. Segesser; Biomechanics Laboratory of the Swiss Institute of Technology, Zurich, Switzerland; *XII International Congress of Biomechanics,* Jun. 1989.

"Torsion and Rearfoot Stability in Running", A. Stacoff, X. Kaelin, E. Stussi and B. Segesser; Biomechanics Laboratory of the Swiss Institute of Technology, Zurich, Switzerland; *XII International Congress of Biomechanics,* Jun. 1989.

The "Courageous" by Saucony, as illustrated in Runners World Magazine, Jun. 1987.

"The Torsion of the Foot in Running", by A. Stacoff, X. Kaelin, E. Stussi and B. Segesser; in *International Journal of Sport Biomechanics,* 1989.

The Converse All–Star model, as illustrated in "The Complete Handbook of Athletic Footwear"; by Melvyn P. Cheskin, p. 15, 1987.

The Adidas "Gazelle", as illustrated in Runners World Magazine, Oct. 1975.

The Lydiard line, as illustrated in a Foot Locker advertisement in Runners World Magazine, May 1978.

"We'd like to compress the story of TRINOMIC cushioning, but we can't", Runners World Magazine, Feb. 1996.

*Primary Examiner*—Ted Kavanaugh
*Attorney, Agent, or Firm*—Banner & Witcoff, Ltd.

[57] ABSTRACT

A sole having the ability to provide both stability and cushioning includes at least one stabilizer positioned at selected locations around the perimeter of the sole. Stabilizers are positioned at perimeter locations where sudden impacts are unlikely and greater resistance to compression is needed to stabilize the running motion. The perimeter areas of the sole most likely to experience sudden impacts during running and like activities remain unencumbered of the stabilizers.

37 Claims, 22 Drawing Sheets

U.S. PATENT DOCUMENTS 4,128,950 12/1978 Bowerman .
4,194,310 3/1980 Bowerman .
4,255,877 3/1981 Bowerman .
4,259,792 4/1981 Halberstadt .
4,302,892 12/1981 Adamik .
4,305,212 12/1981 Coomer .
4,316,332 2/1982 Giese et al. .
4,316,335 2/1982 Giese et al. .
4,322,895 4/1982 Hockerson .
4,354,318 10/1982 Frederick et al. .
4,364,188 12/1982 Turner et al. .
4,367,599 1/1983 Diamant .
4,439,936 4/1984 Clarke et al. .
4,506,462 3/1985 Cavanagh .
4,542,598 9/1985 Misevich et al. .
4,551,930 11/1985 Graham et al. .
4,559,724 12/1985 Norton .
4,561,140 12/1985 Graham et al. .
4,562,651 1/1986 Frederick et al. .
4,654,983 4/1987 Graham et al. .
4,730,402 3/1988 Norton et al. .
4,731,939 3/1988 Parracho et al. .
4,759,136 7/1988 Stewart et al. .
4,779,359 10/1988 Famolare, Jr. .
4,794,707 1/1989 Franklin et al. .
4,817,304 4/1989 Parker et al. .
4,854,057 8/1989 Misevich et al. .
4,876,053 10/1989 Norton et al. .
4,934,072 6/1990 Fredericksen et al. .
4,942,677 7/1990 Flemming et al. .
5,046,267 9/1991 Kilgore et al. .
5,052,130 10/1991 Barry et al. .
5,077,915 1/1992 Gross .
5,092,060 3/1992 Frachey et al. .
5,097,607 3/1992 Fredericksen .
5,152,081 10/1992 Hallenbeck et al. .
5,155,927 10/1992 Bates et al. .
5,197,206 3/1993 Shorten .
5,197,207 3/1993 Shorten .
5,201,125 4/1993 Shorten .
5,220,737 6/1993 Edington .
5,255,451 10/1993 Tong et al. .
5,313,717 5/1994 Allen et al. .
5,363,570 11/1994 Allen et al. .
5,375,346 12/1994 Cole et al. .
5,381,607 1/1995 Sussmann .
5,384,973 1/1995 Lyden .
5,396,675 3/1995 Vincent et al. .
5,416,986 5/1995 Cole et al. .
5,425,184 6/1995 Lyden .
5,448,839 9/1995 Blissett et al. .
5,595,004 1/1997 Lyden et al. .
5,625,964 5/1997 Lyden et al. .

FOOTWEAR WITH STABILIZERS

This application is a continuation-in-part of U.S. patent application Ser. No. 08/476,104, filed Jun. 7, 1995, now abandoned.

FIELD OF THE INVENTION

The invention pertains to footwear, and especially athletic footwear, wherein the sole includes stabilizers to provide enhanced stability.

BACKGROUND OF THE INVENTION

To provide cushioning protection and support for the foot, the sole of an athletic shoe commonly has a multi-layer construction comprising an outsole, a midsole, and an insole. The outsole is normally formed of a resilient and durable material to resist wearing of the sole during use. In many cases, the outsole includes lugs, cleats or other elements to enhance the cushioning and traction afforded by the sole. The midsole ordinarily forms the middle layer of the sole and is typically composed of a soft foam material to attenuate and dampen impact energy and distribute pressures placed upon the foot during athletic activities. The midsole may be formed with or without the inclusion of other cushioning elements, such as resilient gas-filled bladders. An insole layer is usually a thin, padded member provided overtop of the midsole to enhance the comfort afforded to the wearer. The performance of such footwear depends in large part on the ability of the sole to effectively cushion applied loads relative to the anatomy and skeletal structure of the foot and to stabilize the movements associated with running and like activities.

As to be expected of the running population, there are many different running styles. Nevertheless, approximately eighty percent of the running population makes first contact with the ground along the rear lateral corner 53 of the sole when running at moderate speeds. Individuals having this running style are commonly referred to as rearfoot strikers. By and large, the remaining twenty percent of the running population generally makes first contact along the lateral side of the sole. Often, first ground contact for these runners will occur at or between proximal head 31*e* of fifth metatarsal 34*e* and metatarsal-phalangeal joint 35*e*.

It has been common practice to use a thin band about the entire perimeter of the sole or otherwise indiscriminately proximate to those portions of the rearfoot, midfoot or forefoot associated with sudden impact events. Shock waves generated by an impact travel at a rate exceeding 1500 meters/second in soft tissue, and at a rate exceeding 3000 meters/second in bone. Accordingly, a soft cushion is needed proximate the point of impact to provide a rapid and sufficient cushioning response. Some of the most potentially damaging accelerations associated with running occur during the first few milliseconds of footstrike; that is, long before the cushioning materials located more centrally in a shoe sole can be brought to bear upon the support surface.

As can be appreciated, the construction of the sole must be coordinated with the foot structure and running styles in order for a sole to provide effective cushioning and stability. The skeletal structure of foot 8 provides the requisite strength to support the weight of the body during the ground contact and the remainder of the ground support phase. The structure of the foot can be categorized into three areas—namely, rearfoot area 9*a*, midfoot area 9*b*, and forefoot area 9*c* (FIG. 4).

Rearfoot area 9*a* includes talus 13 and calcaneus 17. The tibia and fibula of the leg are movably attached to talus 13 to form the ankle joint. In general, these leg bones form a mortise into which a portion of talus 13 is received to form a hinge-type joint which allows both dorsi and plantar flexion of the foot. Talus 13 overlies and is movably interconnected to calcaneus 17 to form the subtalar joint. The subtalar joint enables the foot to move in a generally rotative, side-to-side motion. Rearfoot pronation and supination of the foot is generally defined by movement about this joint.

Midfoot area 9*b* is anterior to rearfoot area 9*a* and comprises navicular 20, cuboid 21 and outer, middle and inner cuneiforms 22–24. The four latter bones 21–24 facilitate interconnection of the tarsus to the metatarsus.

Forefoot area 9*a* is anterior to midfoot area 9*b* and includes: metatarsals 34*a*, 34*b*, 34*c*, 34*d*, 34*e*; metatarsal-phalangeal joints 35*a*, 35*b*, 35*c*, 35*d*, 35*e*; sesamoids 36*a*, 36*b*; proximal phalanges 45*a*, 45*b*, 45*c*, 45*d*, 45*e*; distal phalanges 46*a*, 46*b*, 46*c*, 46*d*, 46*e*; and middle phalanges 47*b*, 47*c*, 47*d*, 47*e*.

Each metatarsal 34*a–e* is aligned with and attached via connective tissue to one of the proximal phalanges 45*a–e* at metatarsal-phalangeal joints 35*a–e*. For example, first metatarsal 34*a* is connected to proximal phalange 45*a* of the big toe 40*a*, and fifth metatarsal 34*e* is connected to proximal phalange 45*e* of the smallest or fifth toe 40*e*. First, second and third metatarsals 34*a–c* are largely attached on their proximal ends to outer, middle and inner cuneiforms 22–24, respectively. Fourth and fifth metatarsals 34*d–e* are both substantially connected to cuboid 21. Toes 40*a*, 40*b*, 40*c*, 40*d*, 40*e* are hingedly attached to the metatarsals for significant movement.

During running, the ground support phase of a step generally includes a braking phase, a stance phase, and a propulsive phase. The braking phase occurs when the foot makes first contact with the ground and the foot begins to flatten. The stance phase follows the braking phase and is generally considered to consist of the time when the foot flattens and the runner's center of gravity is generally located above the foot. The propulsive phase is characterized by the rising of the heel from the ground and the shifting of the runner's weight to the ball and toes of the foot.

With respect to a rearfoot striker, the foot at heel strike is typically oriented with big toe 40*a* pointing upward and slightly outward (FIG. 5). From the moment heel strikes the ground, and through the braking and stance phases, the foot rotates inwardly (i.e., the foot everts or pronates) and toward the midline of the body (i.e., adducts). During the propulsive phase, the foot rotates outward (i.e., inverts or supinates) and away from the midline of the body (i.e., abducts).

For a rearfoot striker, the plantar center of pressure path 55*a* normally proceeds from the point of first contact 53 towards the midline of the foot and exits between the first and second toes 40*a*, 40*b* (FIG. 6). This action reflects the fact that the individual has maintained balance and stability during the ground support phase. While eversion of the foot in this context is a natural action, excessive eversion or an excessive rate of eversion is sometimes associated with injuries among runners and other athletes. A deviation of the center of pressure path to beneath the first toe 40*a* is indicative of excessive eversion.

For a midfoot striker, first contact with the ground 56 is commonly made near proximal head 31*e* of fifth metatarsal 34*e* (FIG. 7). With these runners, the plantar center of pressure path 55*b* generally moves to the midline of the foot and then exits between the first and second toes 40*a*, 40*b*. For a forefoot striker, first contact with the ground 57 is often proximate the fifth metatarsal-phalangeal joint 35*e* (FIG. 8). The center of plantar pressure path 55*c* for this type of runner often moves rearward towards the midline of the foot before moving forward and exiting between the first and second toes 40*a*, 40*b*.

Moreover, an individual characterized as a rearfoot striker when running at slow or moderate speeds will often modify their technique to become a midfoot striker, and subsequently, a forefoot striker when running at ever increasing speeds. Further, when an individual is in a full sprint as on the straightaway of a running track, the initial point of contact between the foot and the support surface 58 may be near the distal head 33*b* of the second metatarsal 34*b* (FIG. 9). The plantar center of pressure path 55*d* can then proceed directly anteriorly between the first and second toes 40*a*, 40*b*.

Up until about the 1970's, athletic shoes by and large lacked sufficient cushioning. Consequently, injuries were sustained by those engaging in athletic activities. To overcome these shortcomings, manufacturers focused their attention upon enhancing the cushioning provided by athletic shoes. To this end, midsoles have over time been increased in thickness. These endeavors have further led to the incorporation of other cushioning elements within the midsoles and other sole configurations intended to provide enhanced cushioning effects. The industry's focus on improving the cushioning effect has resulted in a marked improvement of shoes in this regard.

Athletic footwear has frequently incorporated a thin band of elastomeric material, such as rubber, around the perimeter of the sole. For example, the Converse All-Star basketball shoe has such a band around the entire perimeter of the shoe. This type of construction is illustrated in FIGS. 1 and 2, wherein a shoe 1 is formed with an upper 2 and sole 3. The sole includes an outsole 3*a*, a midsole 3*b*, and an insole 3*c*. The upper is affixed to a t-stock or board 4 with stitching 5. A thin band stabilizer 6 is affixed along the entire perimeter of the sole by an adhesive, autoclaving or other means. This band is commonly affixed to both the sole and the upper to reinforce the bond therebetween.

Alternatively, the band is applied only around the toe area in many running shoes, including the EB 1120 shoe by Br ütting and Lydiard, and Adidas shoes SL72 and SL76. In addition, other shoes, such as the Adidas Marathon Trainer shoe, has the band applied around the toe and heel areas of the shoe. Similarly, many track and field shoes have included an outsole wrap on the lateral side of the shoe adjacent the fifth metatarsal-phalangeal joint for the purpose of preventing abrasion to the shoe upper and enhancing stability of the foot. Examples of these type of shoes include the Adidas Adistar Sprint and Tiger Spartan B. Other shoes having different kinds of stabilizers, known as midsole wraps, have also been used. For instance, U.S. Pat. Nos. 4,259,792 to Halberstadt and 4,322,895 to Hockerson disclose midsoles extending about the lasting margin of the sole with the shoe upper and encompassing a portion of the shoe upper. Also, stabilizing devices such as taught in U.S. Pat. No. 5,046,267 have been used to increase stiffness in compression exhibited by the medial rearfoot area of the shoe sole. In any event, application of a stabilizing band has in the past been applied indiscriminately with respect to concerns for cushioning.

The band, before being applied to the shoe, is generally relatively elastic and flexible. However, it has not been generally recognized that subsequently affixing this same thin band to the side of the sole and the upper can significantly increase the local stiffness in compression exhibited by the shoe sole. As long as the bond between the thin band and the shoe remains intact and the thin band is not permitted to fold or buckle, compression of the sole portion also requires that the thin band be simultaneously compressed along its transverse or shear plane. The result is a sole which has a much greater stiffness in compression than would be experienced without the band.

As an example, two shoes were tested for relative stiffness in compression by an Instron device Series IX Automated Materials Testing System 1.15. The two shoes were the same, except for a thin band that was applied to the perimeter one of the shoes. The shoe without a thin band exhibited along its edge a stiffness in compression of 9.4 kg/mm. On the other hand, the shoe provided with the band exhibited along its edge a stiffness in compression of 13.2 kg/mm. Accordingly, an increase in stiffness of nearly 30% is realized by application of the band. A graphic representation of the results of this test showing the stiffness in compression versus 0–5 mm of deflection are set forth in FIG. 3.

As opposed to shoes (such as the Converse All-Star Shoe) which provide a stabilizer about the entire perimeter of the shoe, the shoe 75 disclosed in U.S. Pat. No. 3,793,750 to Bowerman, includes a sole which provides enhanced cushioning around the entire perimeter of the sole (FIGS. 10–11). More specifically, shoe 75 has an upper 76 and a sole 77. Sole 77 includes a foam midsole 78 and an outsole 79 with lugs 80. When a load is applied to the sole, the lugs along the perimeter can deflect upwardly more readily, and thus provide greater cushioning, than lugs in the central region of the sole. The lugs along the perimeter experience less resistance because the lugs are bordered by foam material on only three of its four sides.

To illustrate the differences in the compression stiffness of the lugs, a shoe was tested with an above-described Instron device. The lugs of the shoe had a surface area of approximately 10 square mm and a height of approximately 6 mm. The lugs in the center of the sole had a stiffness in compression of 13.96 kg/mm, whereas the lugs along the perimeter had a stiffness of 9.33 kg/mm. As can be appreciated, this is a difference in stiffness of nearly 35%. FIG. 12 provides a graphic representation of the stiffness in compression versus millimeters of deflection for the lugs along the perimeter and in the middle of the sole.

While cushioning advances are important, the benefits realized in cushioning have sometimes led to a degradation of a shoe's stability. Inadequate running stability, like inadequate cushioning, can result in an increased risk of injury. As discussed above, undue amounts of eversion or inversion, or excessive rates of eversion or inversion, can lead to injuries for runners. Moreover, forces generated between the foot and the ground during the ground support phase can also produce visible and generally equal and opposite physical reactions in the lower extremities during the subsequent flight phase. For example, severe inward or outward rotation of the foot during the propulsive phase can produce rotative or counter-rotative movements in the lower extremities during the flight phase. These generally inefficient movements, commonly called "whips" by athletic coaches, can also be associated with an increased potential for injury.

In an effort to provide greater stability, some shoe soles have in the past included stabilizers about the periphery of the sole. For example, stabilizers in the form of stiffer cushioning materials have been provided in an effort to prevent excessive eversion. U.S. Pat. No. 4,551,930 to Graham et al. discloses a shoe wherein stiffer foam material is positioned about the entire perimeter of the sole. Similarly, U.S. Pat. No. 4,128,950 to Bowerman et al. discloses a shoe wherein stiffer foam material is positioned about the perimeter of the heel area. While the stability of these shoes in certain areas, like the shoes discussed above with the bands, can be enhanced, the stability is sometimes gained at the expense of cushioning. The introduction of materials having a greater relative stiffness in compression about the heel, in particular the lateral rear corner of the sole reduces the potential cushioning available during heel strike. Further, the use of stiffer material in the rear lateral corner can effectively create an extended lever arm which can actually compromise rearfoot stability by increasing both the rate and amount of exhibited pronation.

SUMMARY OF THE INVENTION

The present invention pertains to a sole having the ability to provide both stability and cushioning in order to enhance performance and lessen the risk of injury. The sole of the present invention includes stabilizers positioned at selected locations around the perimeter of the sole. The perimeter areas of the sole most likely to experience sudden impact loads during running and like activities remain unencumbered of stabilizers. Stabilizers are, however, positioned at perimeter locations where sudden impact loads are unlikely and greater resistance to compression is needed to stabilize the running motion.

DETAILED DESCRIPTION OF THE PREFERRED EMBODIMENTS

Figure 13:
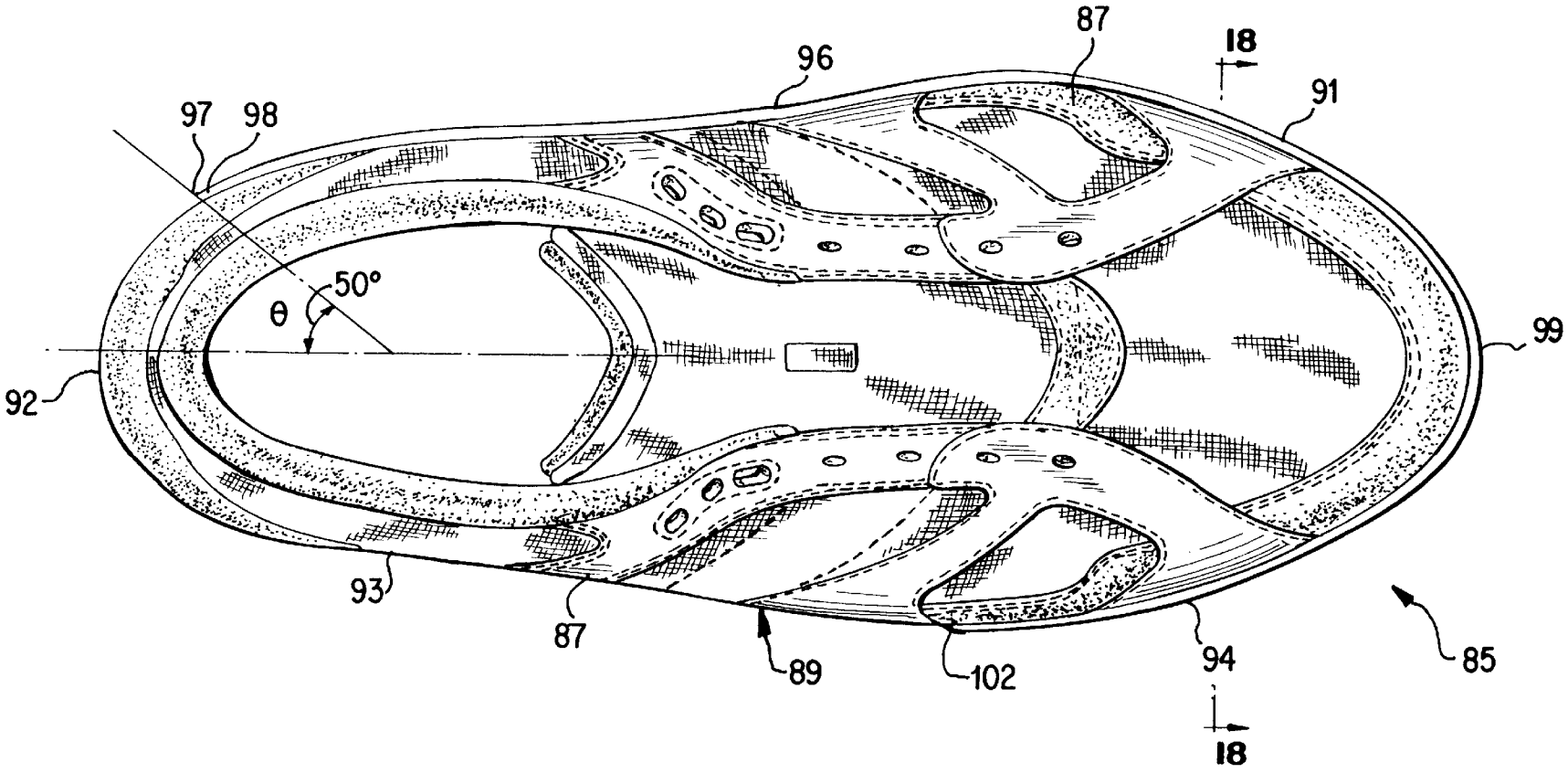
FIG. 13 is a top view of a shoe in accordance with the present invention.

The present invention pertains to footwear 85 having an upper 87 and a sole 89. The upper can have a number of different constructions (FIG. 13). In the preferred embodiment, upper 87 has a conventional athletic shoe construction. Nonetheless, the upper may also consist of straps (e.g., a sandal) or other constructions suitable for securing the footwear to a foot. Upper 87 is secured to sole 89 which typically includes an outsole, a midsole, and an insole. However, other sole constructions could also be used.

The present invention pertains to footwear 85 provided with at least one stabilizer positioned at a selected location (s) along the perimeter of the sole. In the preferred embodiment, the stabilizer is a thin band 91 of elastic material. Nevertheless, other stabilizers could be used in lieu of or in combination with a band, such as: outsole wraps; midsole wraps; high density foam materials, for example, as taught in U.S. Pat. No. 4,128,950, which is hereby incorporated by reference; footframes; moderators; lugs; sidewall stabilizers; arch support stabilizers; and other stabilizing devices, for example, as taught in U.S. Pat. No. 5,046,267, which is hereby incorporated by reference.

In the preferred construction, band 91 or other suitable stabilizer extends along those portions of the perimeter where sudden impact during running activity is unlikely, and where running stability can be enhanced with greater stiffness in compression. Those areas along the perimeter of the sole which are most likely to experience sudden impacts during running and like activities are devoid of the stabilizer.

As discussed in U.S. Pat. Nos. 5,425,184 and 5,625,964, both of which are hereby incorporated by reference, heel strike for rearfoot strikers ordinarily occurs in an area about the lateral rear corner of the sole, known as the rearfoot strike zone 92. More specifically, with respect to the lateral side wall 94, heel strike generally occurs rearward of the junction 93 between calcaneus 17 and cuboid 21. With regard to the medial side wall 96, heel strike does not generally occur much beyond the longitudinal center of the rear side of the heel. Concern for heel strike on the medial side is generally limited to an area conveniently described in relation to the nominal weight bearing center 95 of the heel. Specifically, the medial termination point 97 for rearfoot strike zone 92 may be described in terms of an angle e formed between the longitudinal center axis of sole 89 and a line drawn from the nominal weight bearing center 95 of the heel to point 97. Medial extension of the rearfoot strike zone to a point 97 which creates an angle θ of 10° to the longitudinal axis is satisfactory to accommodate the heel strike of most rearfoot strikers. However, the termination point may be varied to define an angle θ increased up to about 50° for greater inclusiveness of the range of possible heel strikes.

In the preferred embodiment, one end 98 of band 91 is attached to the upper and sole at or near termination point 97 as described above. From point 97, band 91 extends forwardly along medial side wall 96. Band 91 does not encroach into the rearfoot strike zone where heel strike is likely to occur. Accordingly, maximum cushioning efforts can be made in the rearfoot strike zone to protect against the expected sudden impact loading. The provision of the band forwardly of point 97 provides a greater stiffness in compression, and thus, the shoe with a greater degree of stability. The application of band 91 in this location can be particularly beneficial for runners exhibiting a tendency towards excessive eversion (i.e., over pronation).

Figure 1:
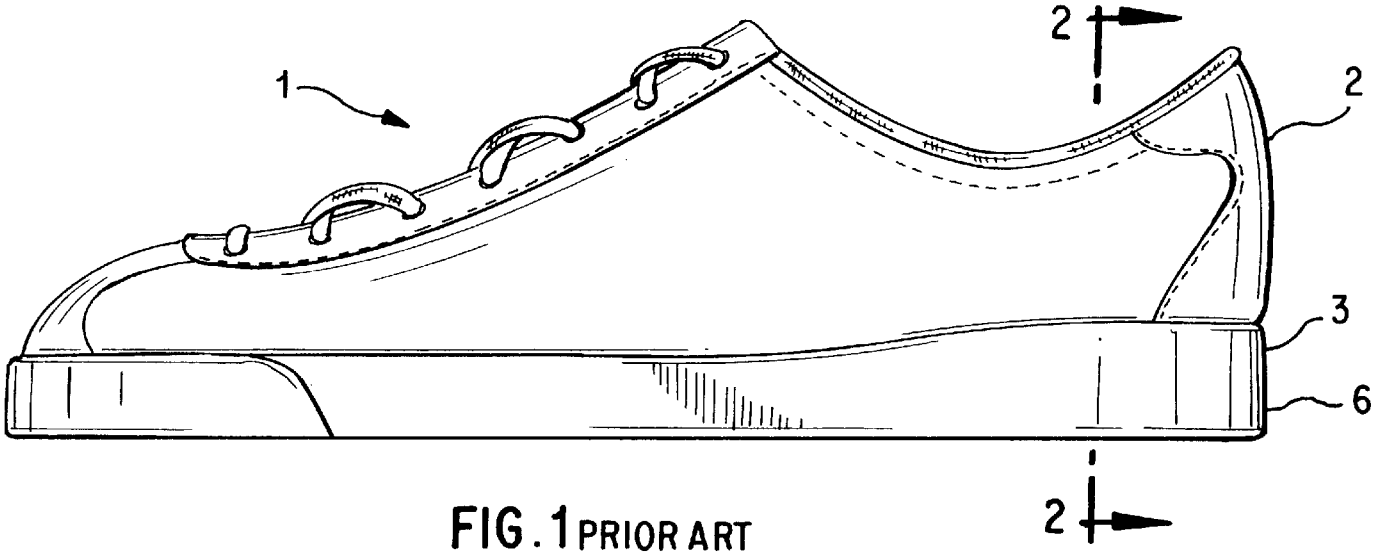
FIG. 1 PRIOR ART
FIG. 1 is a side view of a prior art shoe.
Figure 2:
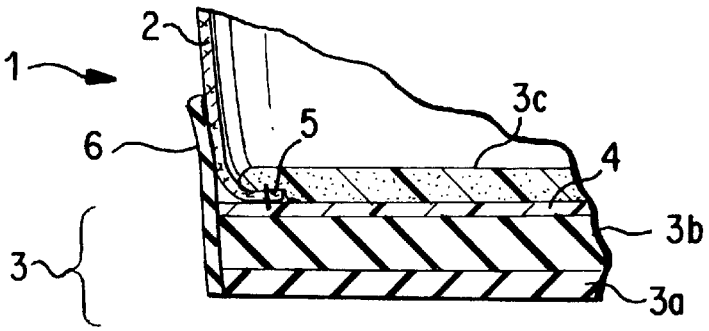
FIG. 2 PRIOR ART
FIG. 2 is a cross sectional view taken along line 2—2 in FIG. 1.
Figure 3:
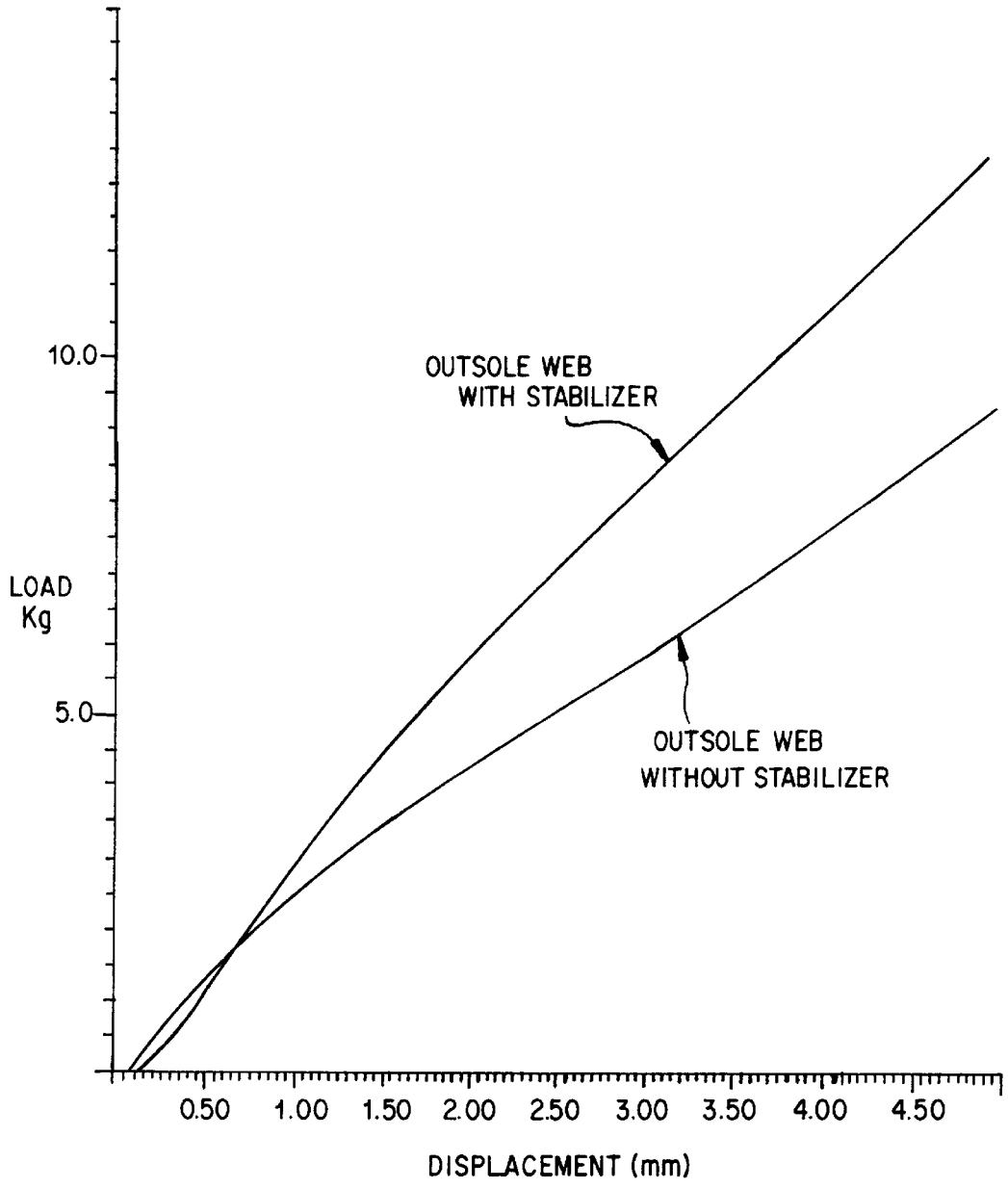
FIG. 3 is a graphic representation of test results involving a shoe with a stabilizer and a shoe without a stabilizer.
Figure 4:
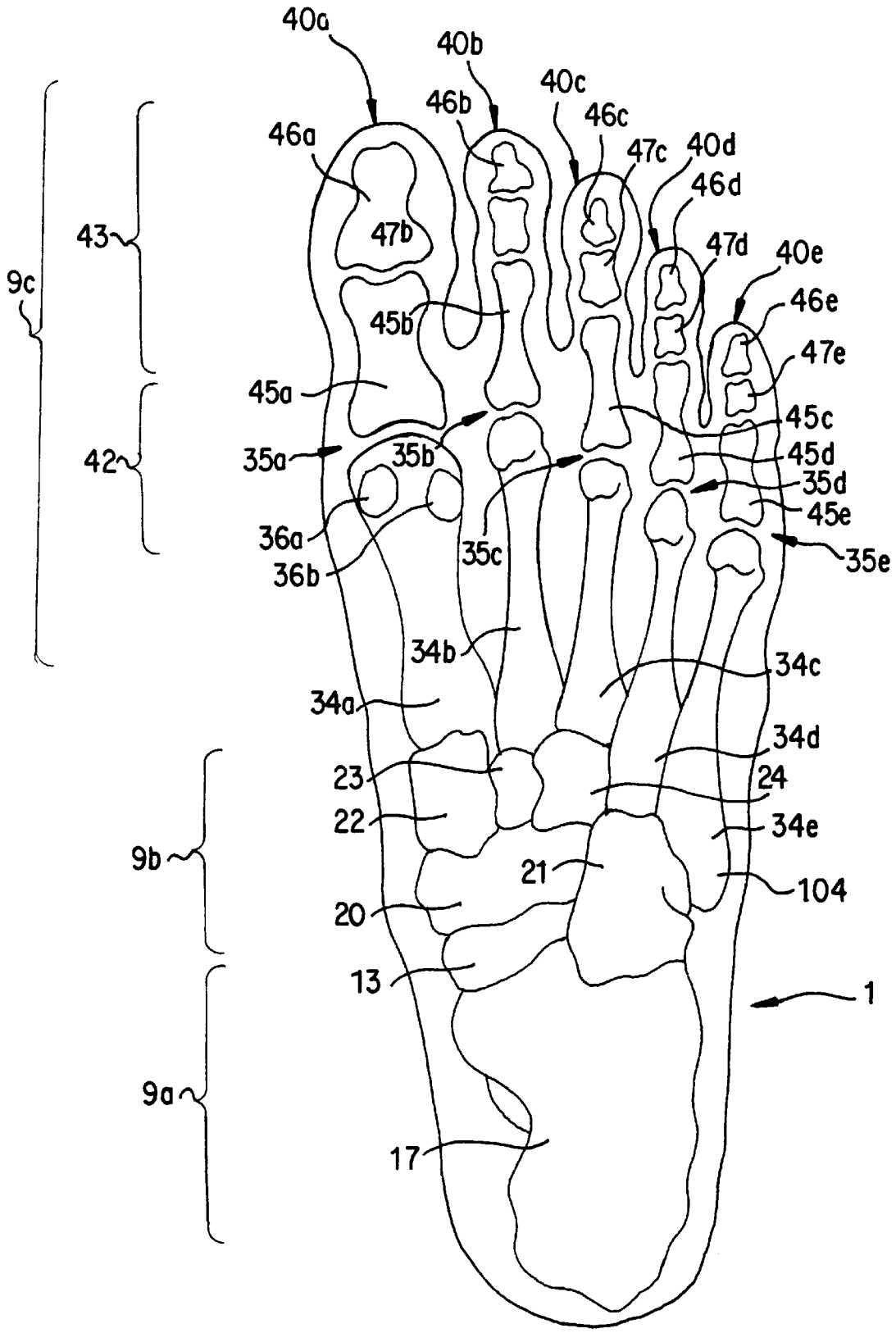
FIG. 4 is a bottom view of the bones of the foot.
Figure 6:
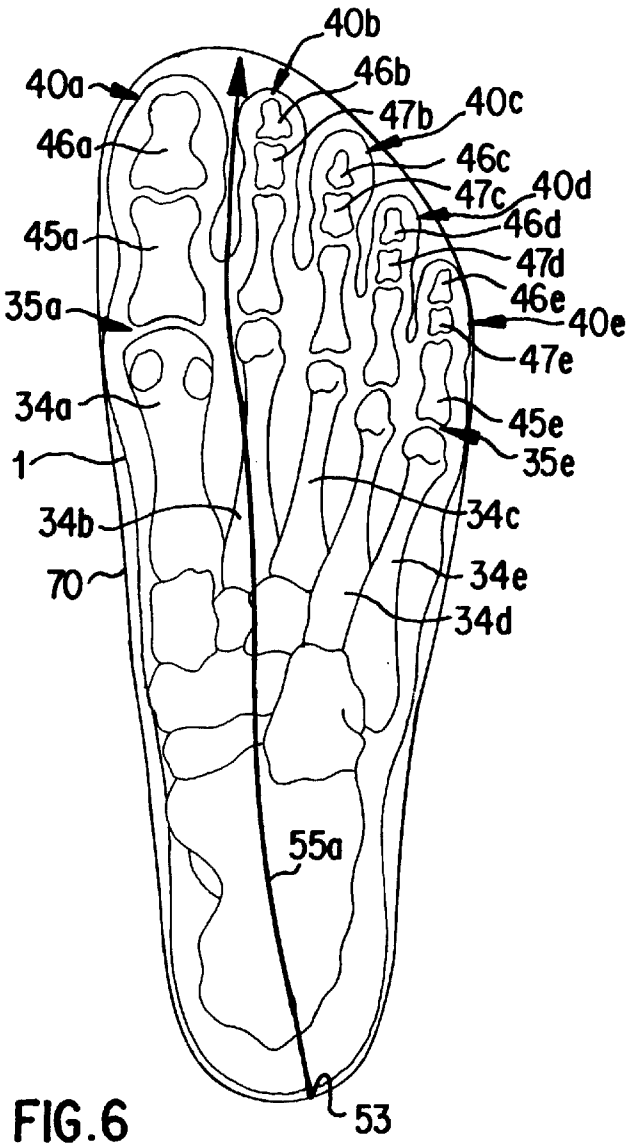
FIG. 6 is top view of the bones of a foot (with only the bones of the forefoot shown in detail) illustrating the plantar center of pressure path for an individual characterized as a rearfoot striker.
Figure 5:
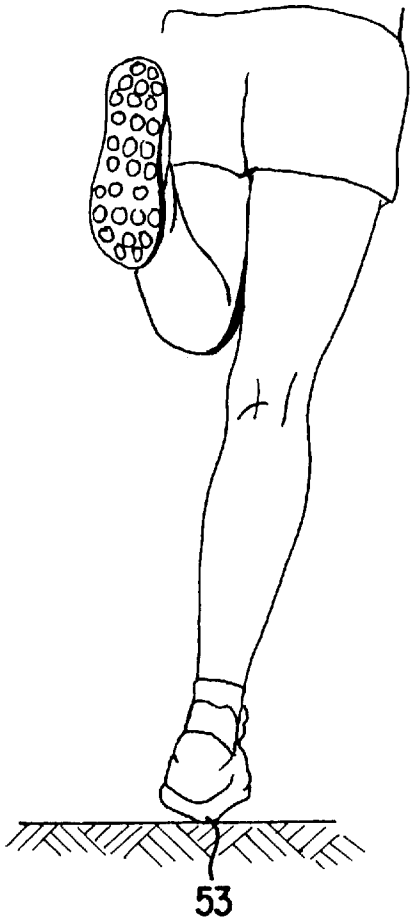
FIG. 5 is a rear view of a typical rearfoot striker.
Figure 9:
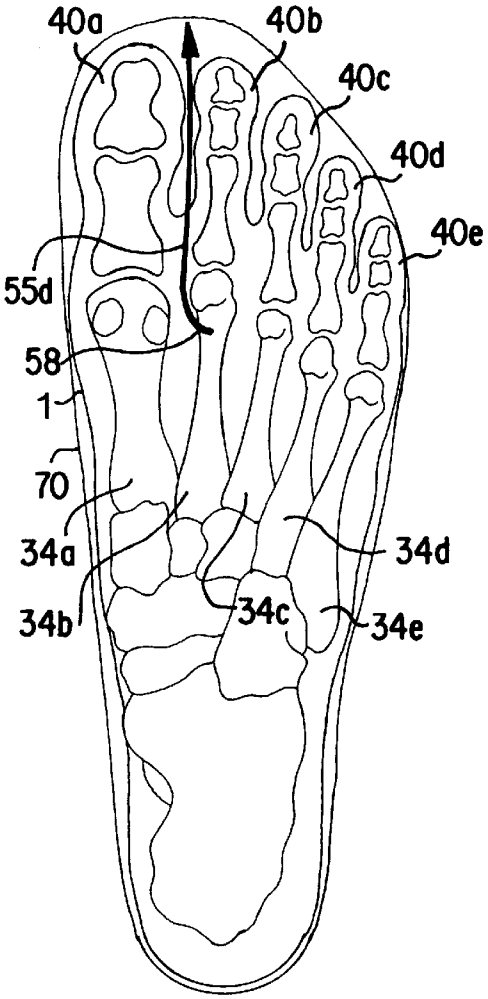
FIG. 9 is top view of the bones of a foot (with only the bones of the forefoot shown in detail) illustrating the plantar center of pressure path for an individual in a full sprint on a straightaway.
Figure 8:
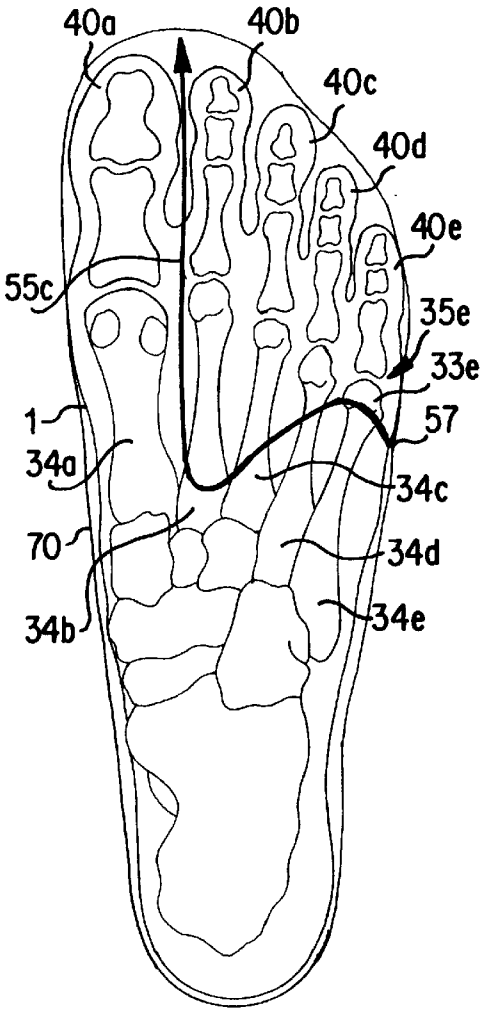
FIG. 8 is top view of the bones of a foot (with only the bones of the forefoot shown in detail) illustrating the plantar center of pressure path for an individual characterized as a forefoot striker.
Figure 7:
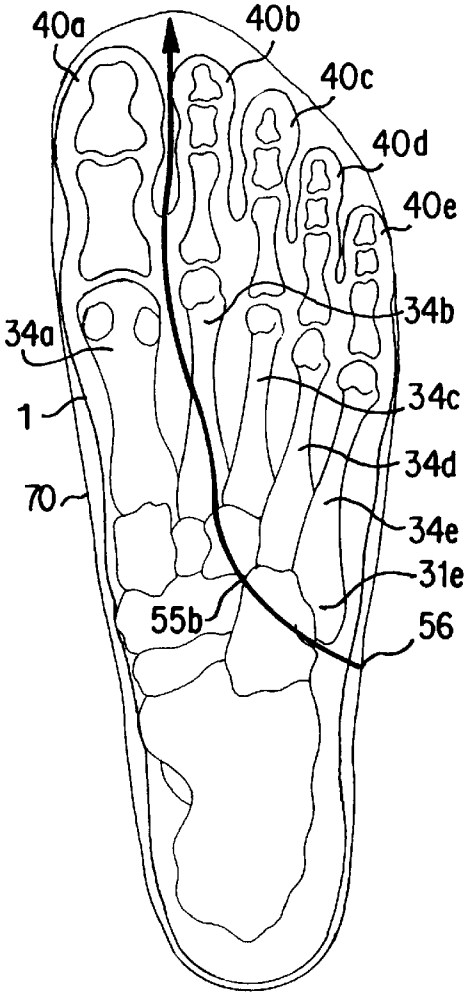
FIG. 7 is top view of the bones of a foot (with only the bones of the forefoot shown in detail) illustrating the plantar center of pressure path for an individual characterized as a midfoot striker.
Figure 10:
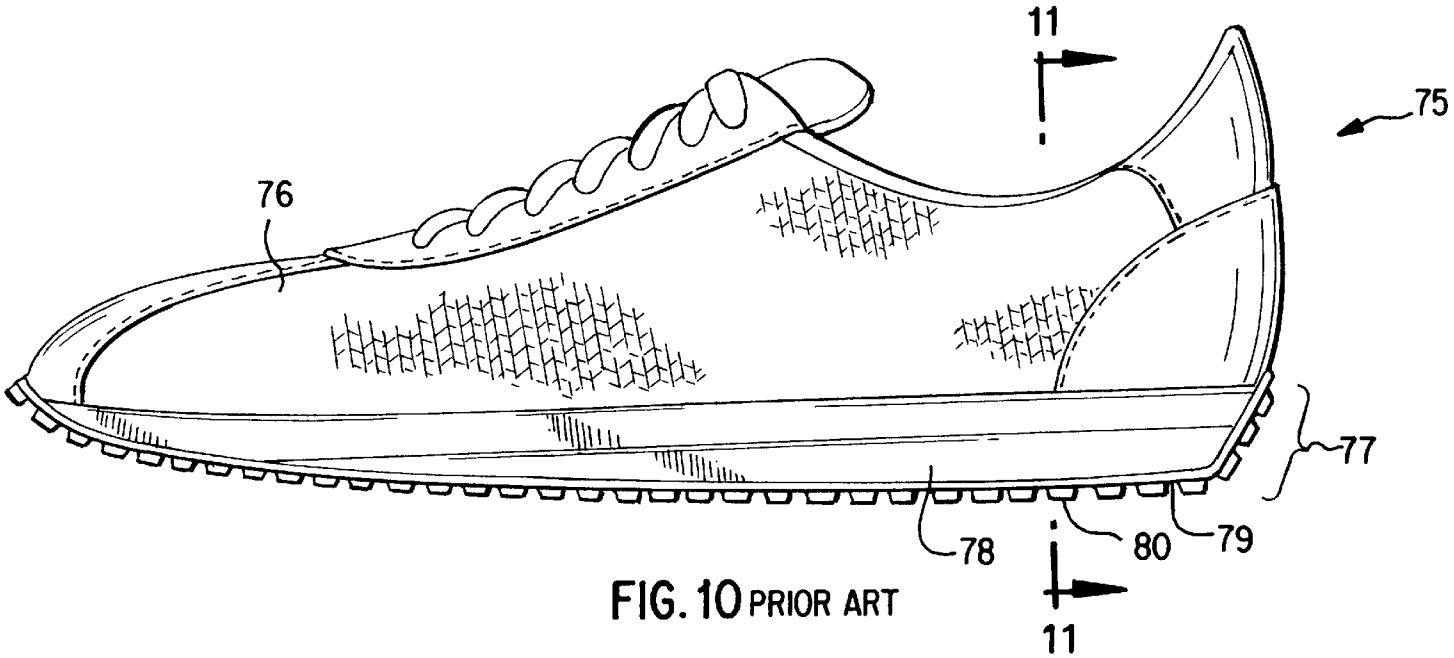
FIG. 10 PRIOR ART
FIG. 10 is a side view of another prior art shoe.
Figure 11:
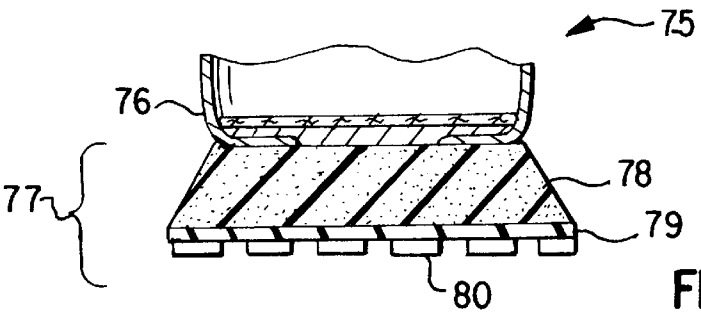
FIG. 11 PRIOR ART
FIG. 11 is a cross section taken along line 11—11 in FIG. 10.
Figure 12:
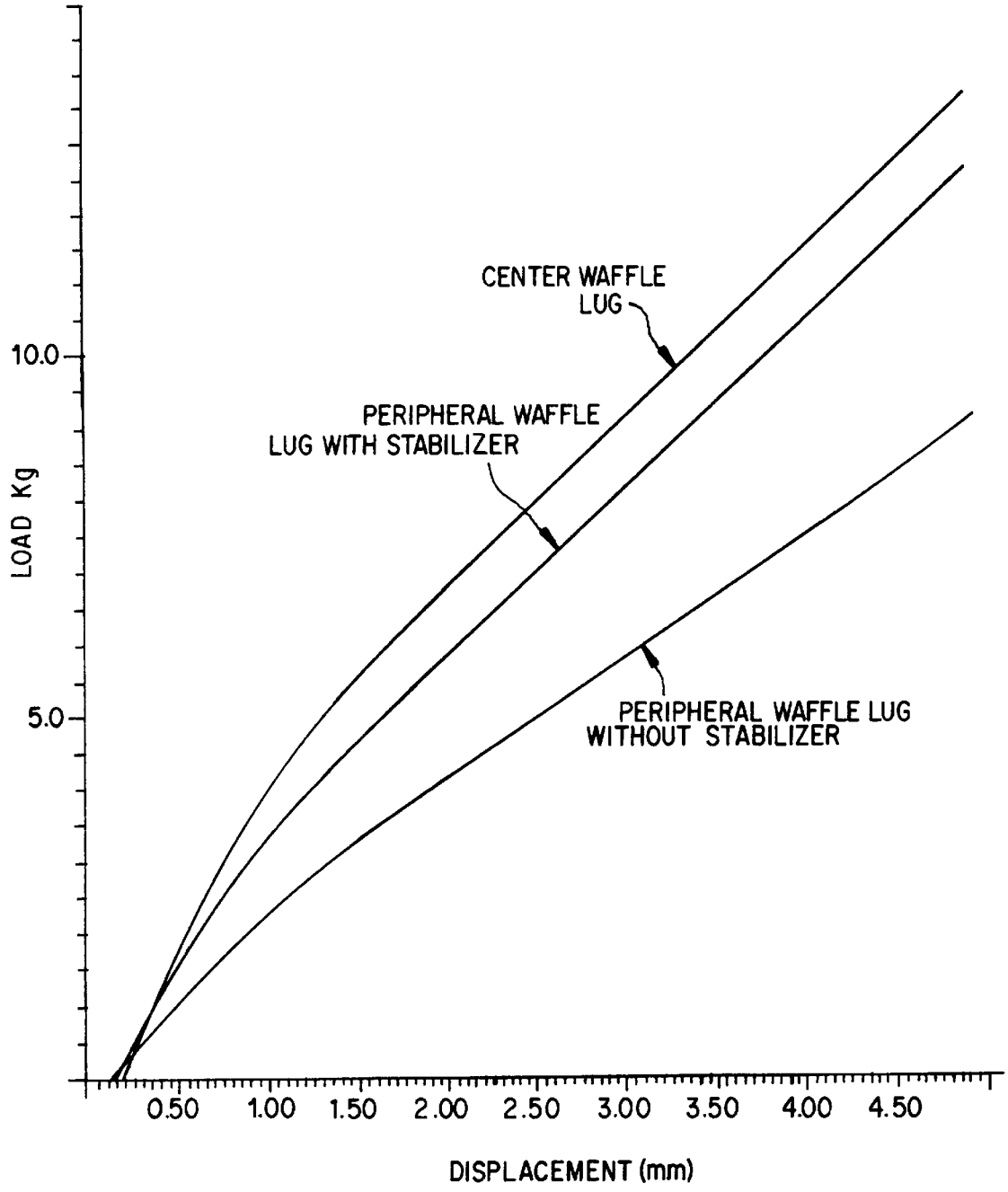
FIG. 12 is a graphic representation of test results involving lugs which are located along a perimeter of a sole and lugs located in a central portion of the sole.

As set forth in co-pending U.S. patent application Ser. No. 08/879,989 still pending (which is a continuation-in-part of U.S. patent application Ser. No. 08/479,805, now abandoned), by Robert M. Lyden, entitled "Footwear With Differential Cushioning Regions," filed Jul. 8, 1997, and hereby incorporated by reference, high pressures are normally associated with the medial side of the sole, particularly under big toe 40*a* and adjacent first metatarsal-phalangeal joint 35*a*. However, these areas are not likely to experience substantial and sudden impact loading during running. As discussed above, first contact with the ground ordinarily occurs in the rearfoot area as shown in FIG. 6 at 53, along lateral side wall 76 as shown in FIGS. 7 and 8 at 56 and 57, respectively, or in the center portion of ball area 42, as shown in FIG. 9 at 58. As a result, the level of shock generated along medial side wall 96 of the sole is much less as compared with the level of shock generated along lateral side wall 94. Consequently, extension of band 91 forwardly along the entire medial side wall does not detrimentally affect the sole's ability to provide adequate cushioning protection for the foot.

By providing a firmer cushion along medial side wall 96, the sole is able to offer resistance to the media rolling of the foot, i.e., eversion, and provide a better support for the foot. Enhanced support along medial wall 96 is important for enhanced stability because the medial portion of the foot, and especially big toe 40*a*, play a predominant role in an individual's ability to prevent excessive eversion and stabilize the foot.

In the preferred construction, band 91 extends around the forward end 99 of the shoe and wraps about the perimeter portion of the shoe adjacent fifth toe 40*e*. The other end 102 of band 91 is attached to the shoe at a point adjacent fifth metatarsal-phalangeal joint 35*e*, such that band 91 lies anterior of joint 35*e*. In one example, the end 102 of band 91 extends rearward of the front end of the sole about 35–40 percent of the sole's entire length, although the distance could be less or slightly more. While impact forces are ordinarily associated with lateral side wall 94, first contact with the ground generally occurs rearward of fifth metatarsal-phalangeal joint 35*e* and the toes. Accordingly, a firmer cushion can be provided by band 91 along toes 40*d*–40*e* to resist excessive inversion or outward rotation of the foot during the latter portion of the propulsive phase. In the preferred construction, the perimeter areas of the sole extending between ends 98, 102 of band 91 (i.e., around lateral side wall 94) do not include a stabilizer 91 in order to maximize cushioning to afford protection against sudden impacts.

Figure 14:
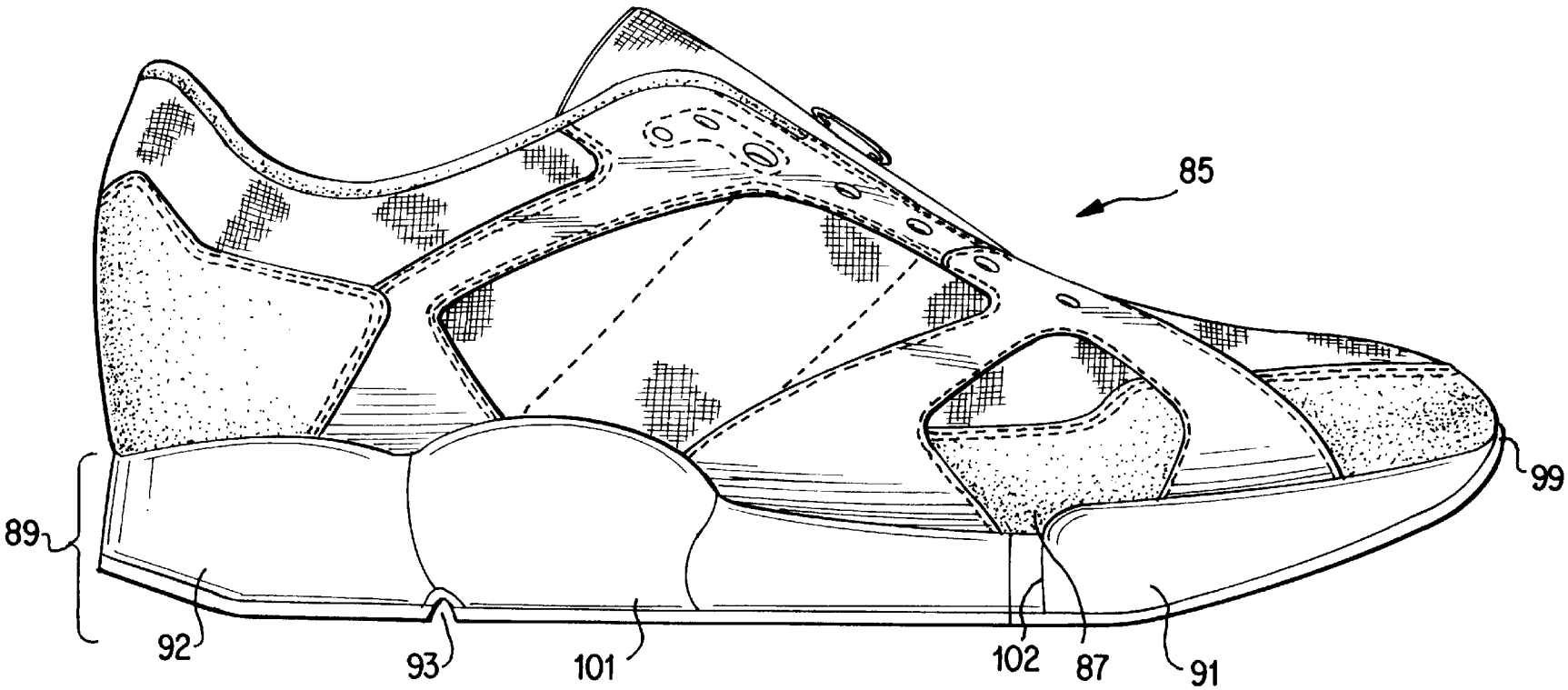
FIG. 14 is a lateral side view of a shoe in accordance with an alternative construction of the present invention.

Nevertheless, an additional stabilizer could be provided along a portion of lateral side wall 96 between ends 98, 102 (FIG. 14). More specifically, since sudden impacts are not ordinarily applied forwardly of juncture point 93 or rearwardly of the proximal head 104 of fifth metatarsal 34*e*, and because of the presence of the lateral longitudinal and transverse arches, an additional stabilizer can be applied along this perimeter portion without substantially comprising cushioning. Accordingly, in this embodiment, band 101 is applied with one end 106 attached to the shoe at point 93 and the other end attached at a point 103 adjacent proximal head 104, such that band 101 lies rearward of head 104. The provision, e.g., of band 101, other stabilizer, or like means to stiffen this area of the sole can be particularly beneficial during the early stages of the braking phase and stance for those exhibiting a propensity for excessive inversion or supination, as such can guide the foot from an inverted to a more neutral position during stance.

Figure 15:
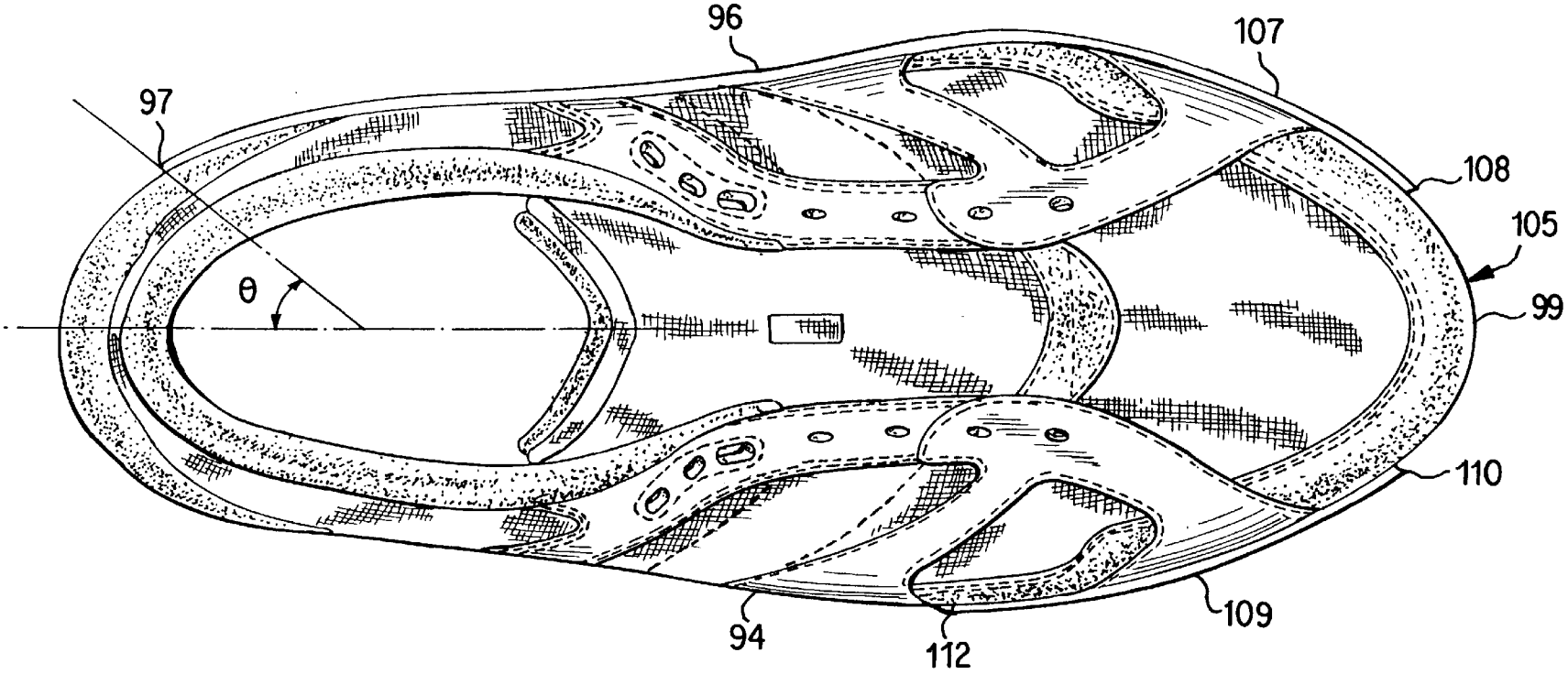
FIG. 15 is a top view of a shoe in accordance with an alternative construction of the present invention.
Figure 17:
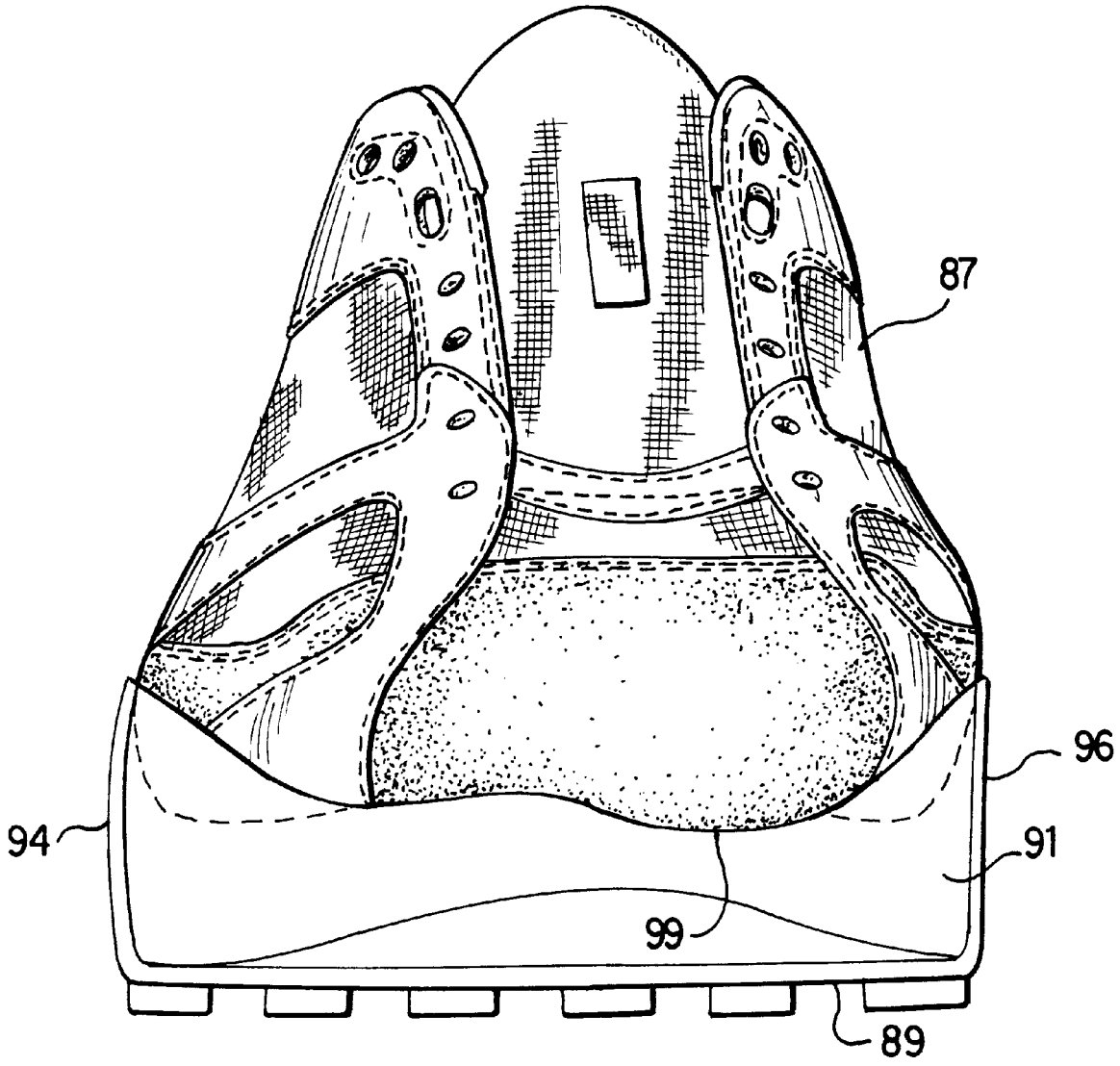
FIG. 17 is a front view of an alternative construction of the present invention.

As an alternative construction, the stabilizer can have a reduced vertical profile (as shown in FIG. 17) or can be omitted around the front end 99 of the shoe (FIG. 15). This open area 105 accommodates movement of the toes 40 during the ground support phase, and in particular, tends to alleviate injury to the toes (e.g., blisters or "black toe") which may possibly be due to abrasion or impact with a stabilizer during downhill running. The extent of open area 105 is subject to variation. In the preferred embodiment, band 107 is attached along the medial side wall from point 97 to a point 108 near the front end of big toe 40*a*. In this way, the desired increase in compression stiffness is provided along the first metatarsal-phalangeal joint 35*a* and the medial side of big toe 40*a*. As discussed above, these areas of the foot are predominately responsible for preventing excessive eversion. Band 109 extends from a point 110 at about the front of the fourth toe 40*d* to a point 112 adjacent fifth metatarsal-phalangeal joint 35*e*, such that band 109 lies anterior of joint 35*e*. In one example, point 108 and point 110 are spaced apart at an angle of about forty degrees as measured from an apex located along a transverse line perpendicular to said longitudinal axis which includes point 112.

Figure 16:
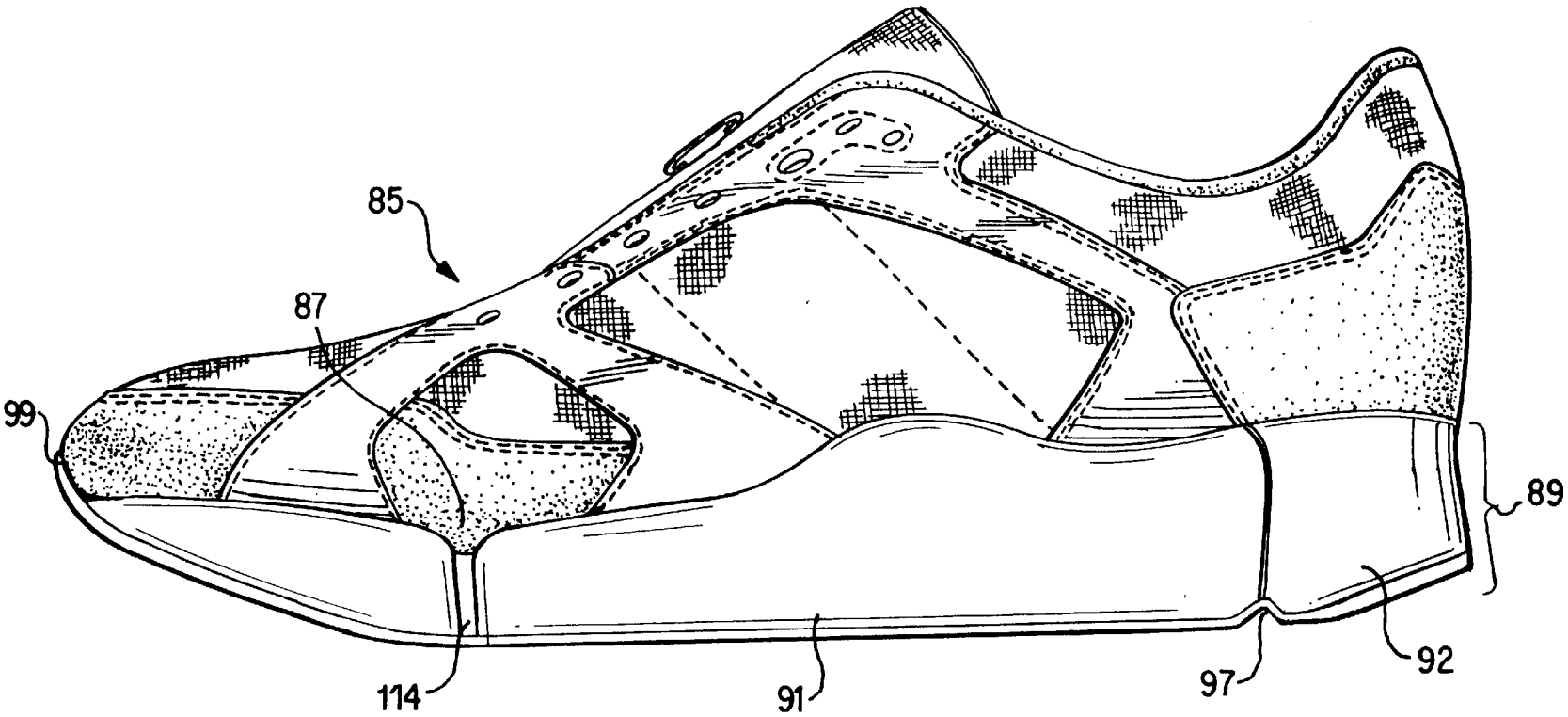
FIG. 16 is a medial side view of a shoe in accordance with an alternative construction of the present invention.

As another alternative, band 91 or 105 can be split at a specific location 114 to enable a line a flexion to extend to the side of the sole (FIG. 16). For instance, a line of flexion 111 can be provided along the base of toes 40*a–e*, as disclosed in U.S. Pat. Nos. 4,562,651 and 5,384,973 which are hereby incorporated by reference, to enhance the flexibility of the sole during the propulsive phase. The split enables the line of flexion to operate without being hampered by the stabilizer. Nevertheless, this narrow gap defined in the stabilizer at point 114 does not significantly affect the stiffness in compression along medial side wall 96.

Figure 18:
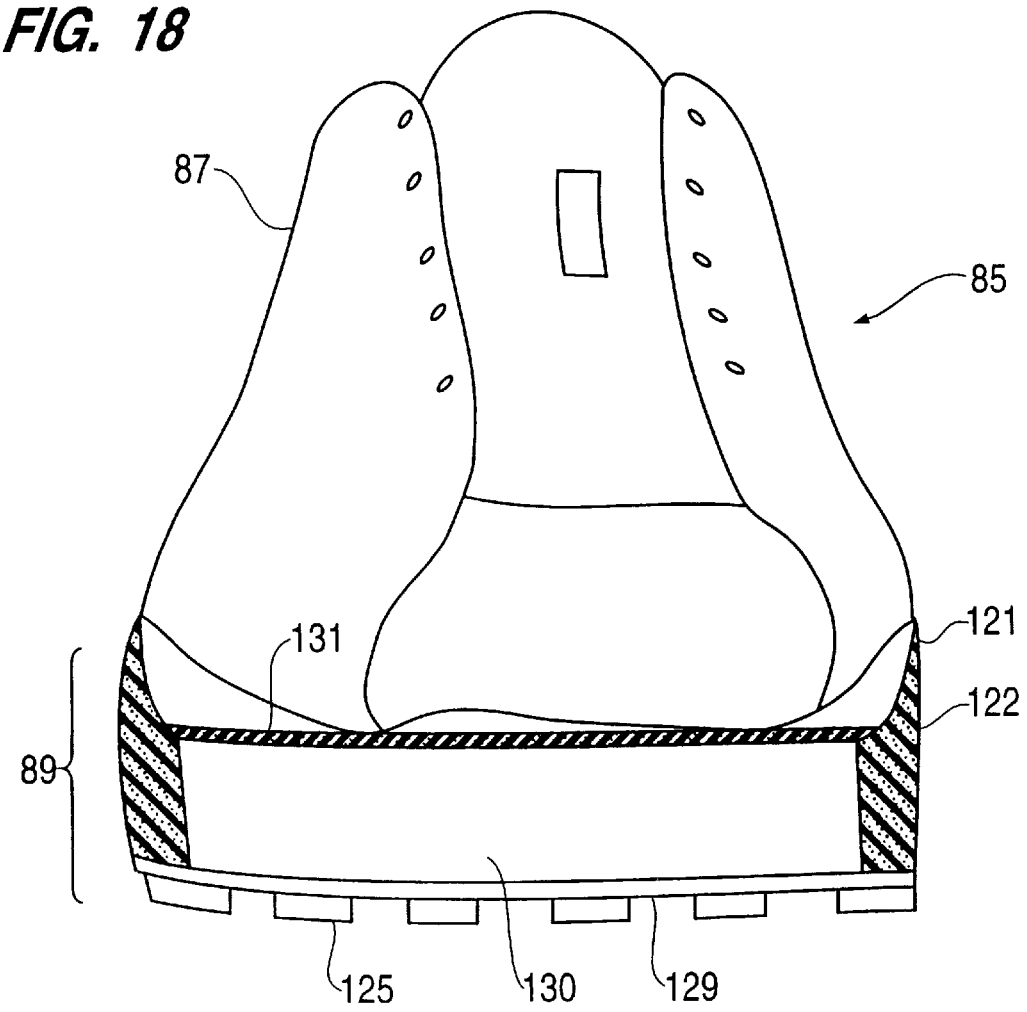
FIG. 18 is a front cross-sectional view consistent with line 18—18 shown in FIG. 13, of an alternate construction of the present invention showing the use of a high density foam material stabilizer about portions of the perimeter of the sole of an article of footwear.

The use of a high density foam material stabilizer 122 about the perimeter of the sole 80 of an article of footwear 85 can be used in a manner consistent with previous discussion of band stabilizer 91 (FIG. 18). The high density foam material stabilizer 122 can optionally be formed in a midsole wrap 121 about a portion of the side of the shoe upper 87, as shown. In some instances, and in particular for the normal population, it can be advantageous that the high density foam stabilizer 122 not extend substantially beyond the margin defined by the insole 131 so as to underlay substantial portions of the foot, as otherwise the wearer's foot could be effectively posted, that is, a portion of the foot could be undesirably placed into a valgus or varus orientation during dynamic loading of the article of footwear. However, it can be readily understood that the high density foam material stabilizer 122 could extend farther beneath the plantar surface of the foot on the medial side of the midfoot and/or forefoot areas in order to better address the needs of runners having a valgus heel and varus forefoot, as is commonly the case with flat-footed individuals. Alternately, the high density foam material stabilizer 122 could extend farther beneath the plantar surface of the foot on the lateral side of the midfoot and/or forefoot areas in order to better address the needs of runners having a varus heel and often a valgus forefoot, as is commonly the case with high arched individuals. It can be readily understood that a different material having greater relative stiffness in compression with respect to the foam material or other material used in the more central areas of the shoe sole could be used in lieu of a relatively high density foam material to achieve the same intended effects for runners having a valgus or varus conditions.

Figure 19:
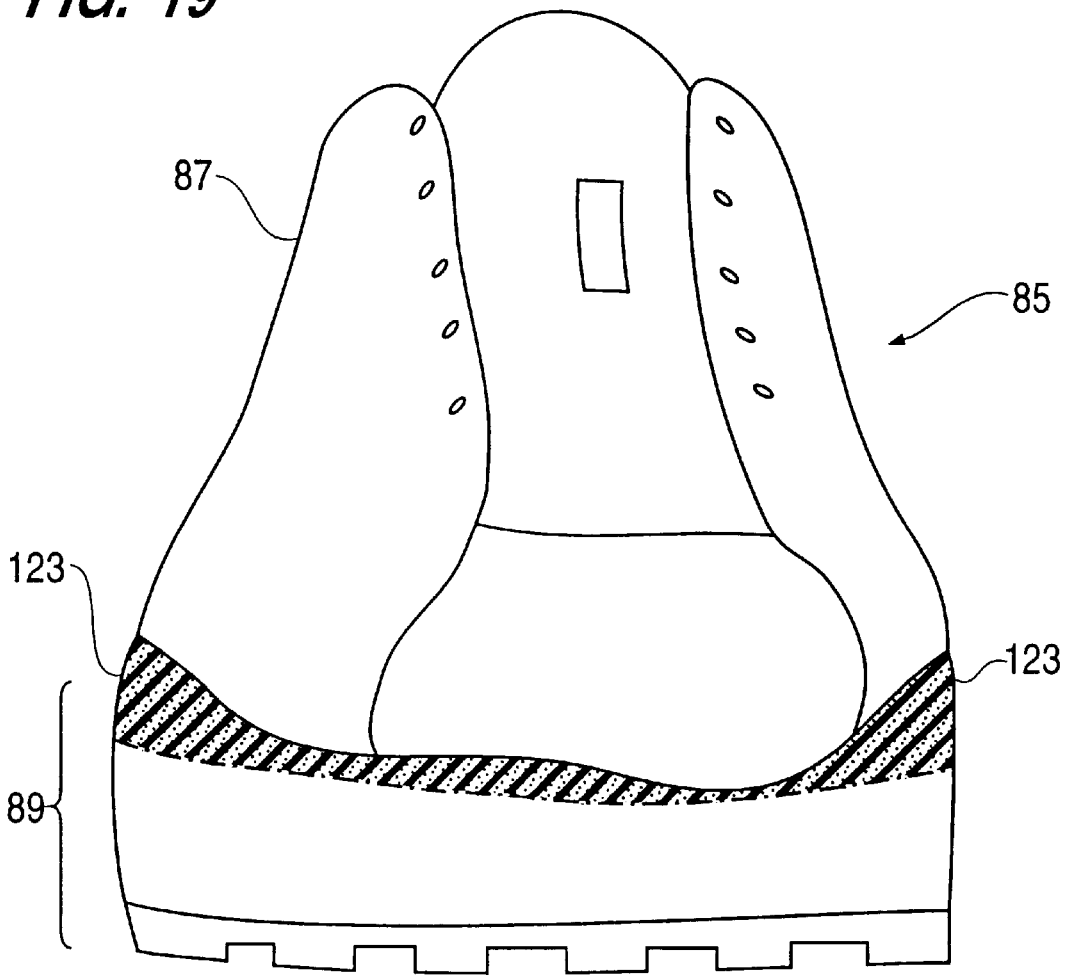
FIG. 19 is a front view of an alternate construction of the present invention showing the use of a footframe stabilizer.

FIG. 19 is a front view of an article of footwear 85 showing the possible use of a footframe stabilizer 123. The footframe stabilizer can serve to limit the motion of the shoe upper 87 relative to the sides of the underlying shoe sole 89. Further, the footframe stabilizer 123 can include generally planar moderator(s) extending some distance from the side of the sole towards the middle of the sole, as shown, e.g., in FIG. 23. The moderator could include finger-like projections such as taught in U.S. Pat. No. 5,046,267, hereby incorporated by reference. The footframe stabilizer 123 can be made, e.g., by a high density foam material, plastic material, rubber material, and the like.

Figure 20:
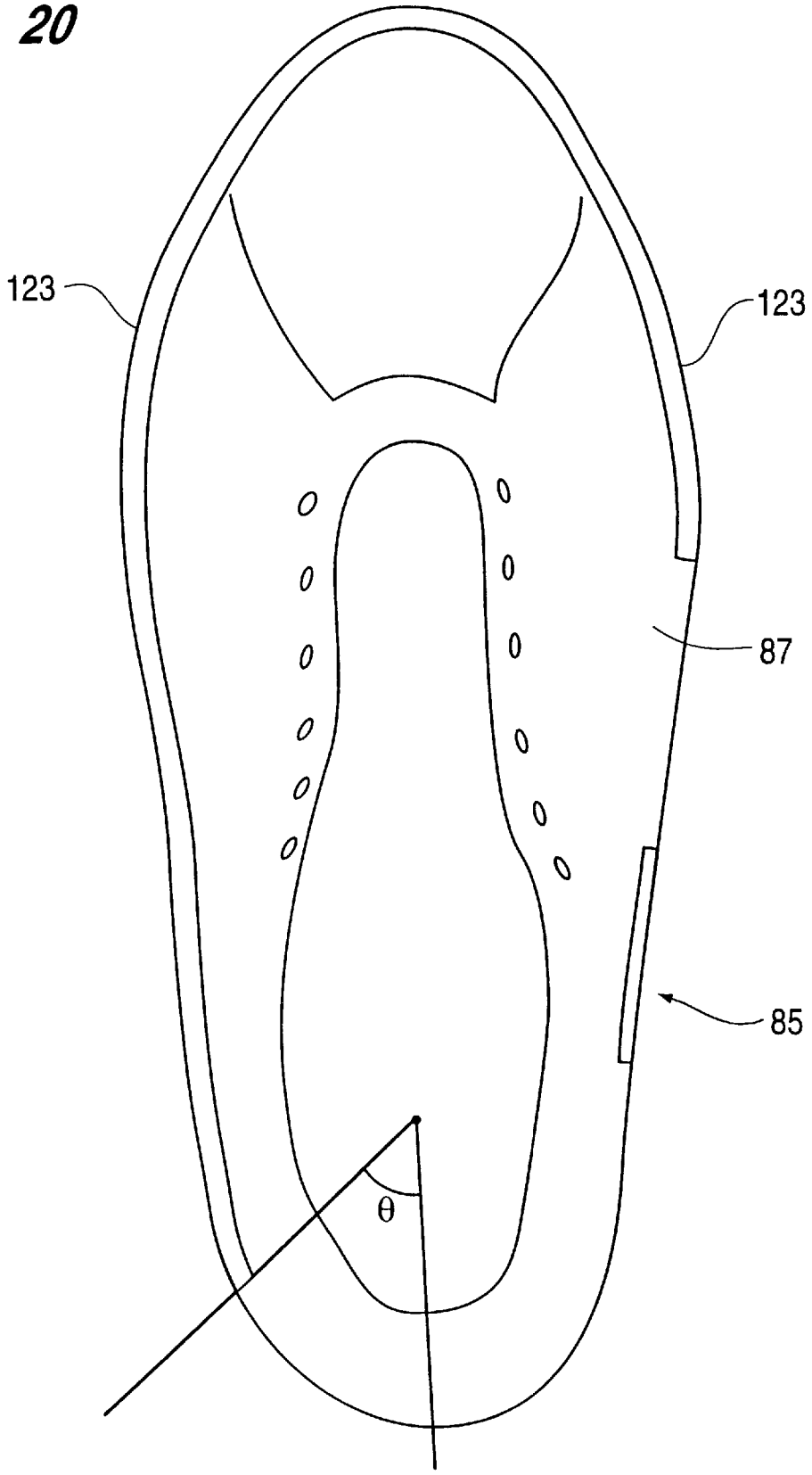
FIG. 20 is a top view of an alternative construction of the present invention showing the use of a footframe stabilizer consistent with that shown in FIG. 19.

FIG. 20 is a top view of an article of footwear 85 showing the possible use of a footframe stabilizer 123 consistent with that shown in FIG. 19. Again, the stabilizer can be used along the medial side of the shoe extending from the anterior most position of the rearfoot strike zone as previously defined herein, and about the front of the shoe to a position proximate but anterior to the fifth metatarsal-phalangeal joint. Optionally, the stabilizer can be omitted in an anterior most portion of the shoe as discussed above in order to avoid black toe or other trauma to the toes of the foot, as could possibly occur during downhill running. Optionally, an area consistent with the midfoot along the lateral side of the shoe could include a stabilizer, as such to help stabilize the motion of an individual who has a tendency to invert the foot or over-supinate.

Figure 21:
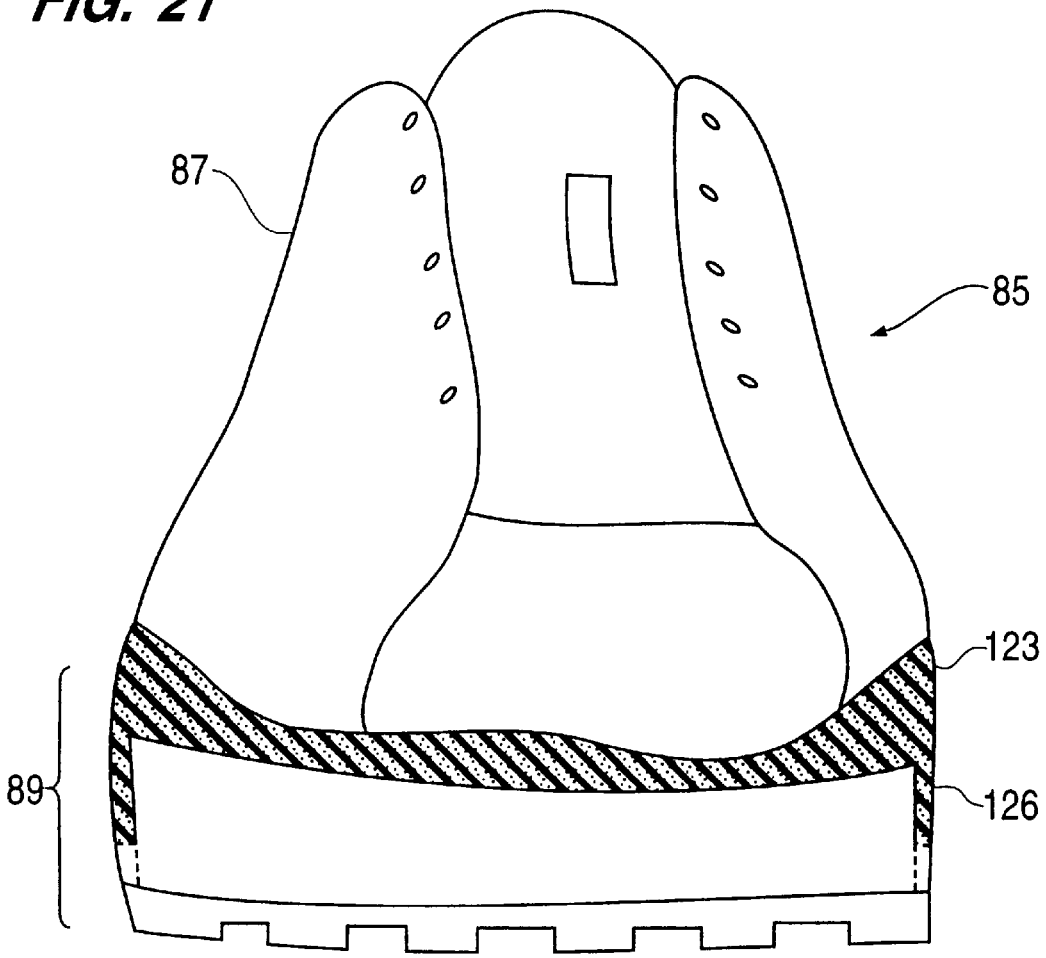
FIG. 21 is a front cross-sectional view consistent with line 18—18 shown in FIG. 13 of an alternate construction of the present invention showing the use of a combination footframe and sidewall stabilizer.

FIG. 21 is a front cross-sectional view, taken along a line consistent with 18—18 as shown in FIG. 13, showing the use of a combination footframe 123 and sidewall stabilizer 126. The sidewall stabilizer 126 portion can project downwards to the outsole, or some distance therefrom, and thus the amount of deflection permitted by the shoe sole in various areas can be at least partially regulated. The footframe and sidewall stabilizer could be made, e.g., of a high density foam material, plastic material, rubber material, and the like. In an alternate embodiment the sidewall stabilizer 126 can be used in combination with a moderator stabilizer 124.

Figure 22:
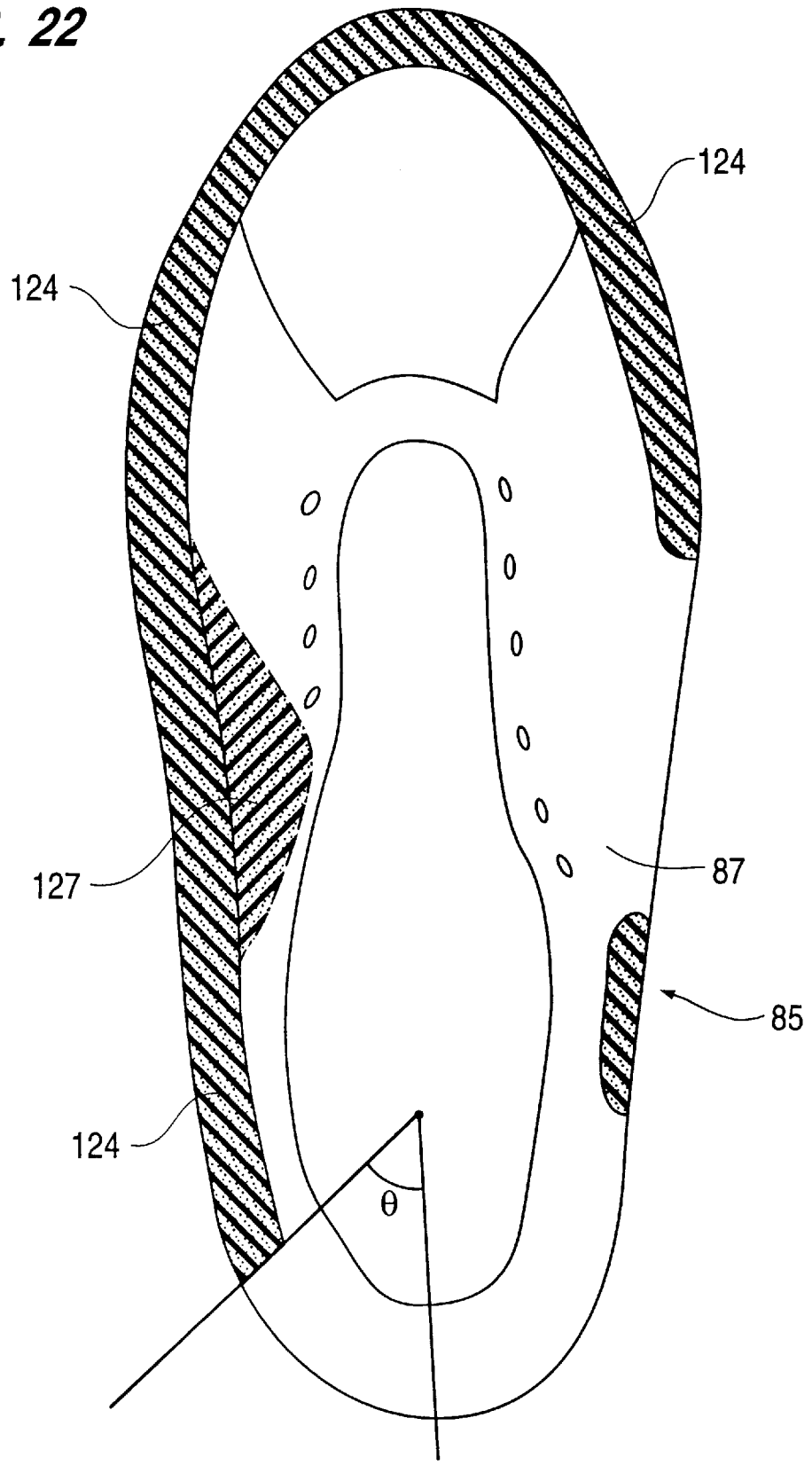
FIG. 22 is a top view of a cross-section taken in the transverse plane of an alternative embodiment of the present invention showing the use of a moderator stabilizer.

FIG. 22 is a top view of a cross-section taken in the transverse plane of an article of footwear 85 showing the use of moderator stabilizer(s) 124. Again, the moderator stabilizer 124 could optionally be removed from an anterior most area of the shoe proximate the distal end of the toes of the wearer's foot as discussed above. Further, the moderator stabilizer 124 could be used in the lateral midfoot area in order to stabilize inversion or supination of a wearer's foot. In addition, the moderator stabilizer 124 could include an integral arch support 127. The arch support could extend partially, or completely, across the width of the sole from the medial to the lateral side, thereby underlying a portion of the longitudinal and transverse arches of the foot. The moderator stabilizer 124 can be made, e.g., of metal, fiber, paper, textile, composite resin material, plastic, rubber, high density foam material, and the like.

Figure 23:
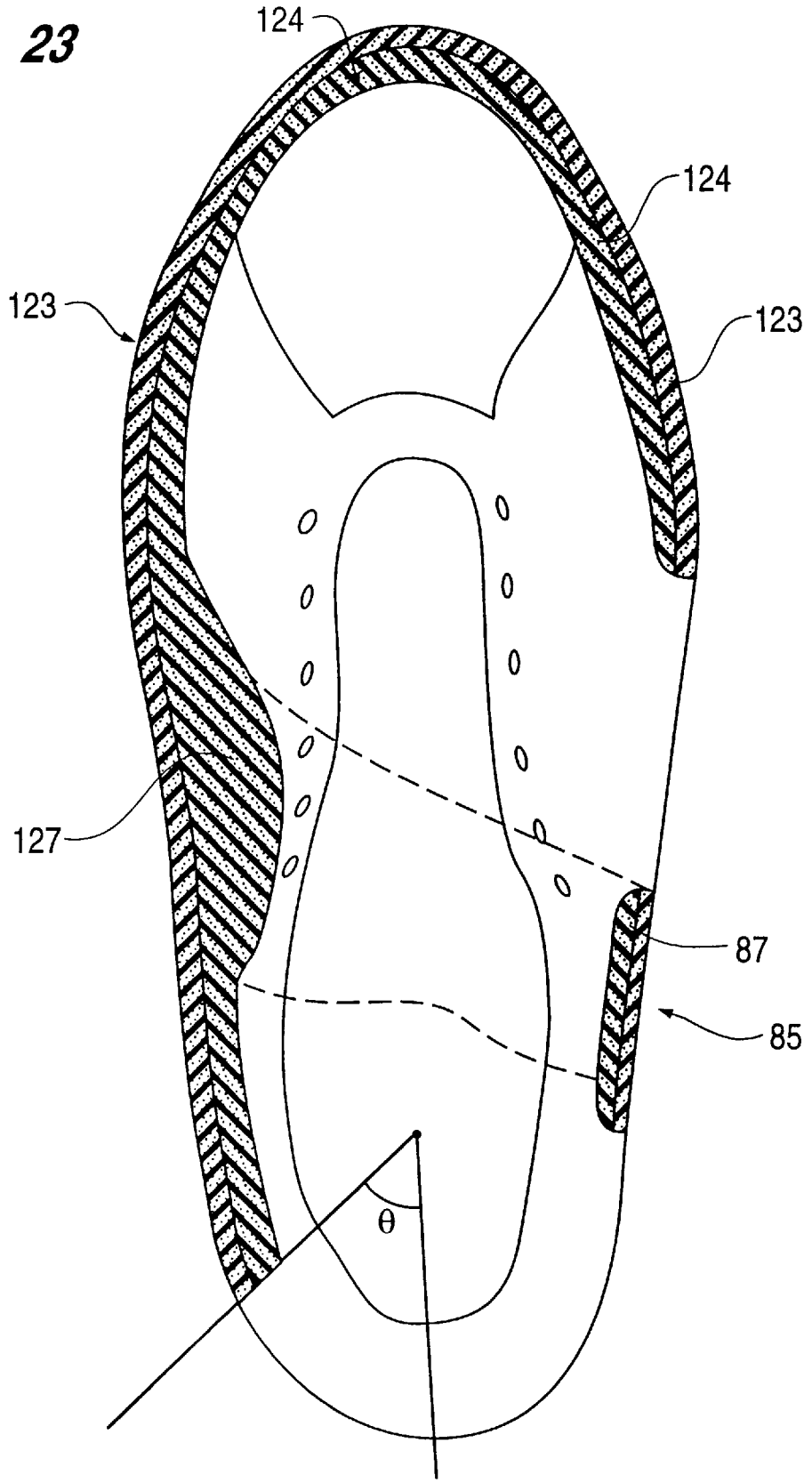
FIG. 23 is top view of a cross-section taken in the transverse plane of an alternative embodiment of the present invention showing the use of a moderator stabilizer in conjunction with a footframe stabilizer.

FIG. 23 is a top view of a cross-section taken in the transverse plane of an article of footwear 85 showing the use of combination footframe 123 and moderator stabilizer(s) 124. Again, the stabilizer(s) could optionally be removed from an anterior most area of the shoe proximate the distal end of the toes of the wearer's foot as discussed above. Further, a combination footframe 123 and/or moderator stabilizer 124 could be used in the lateral midfoot area in order to stabilize inversion or supination of a wearer's foot.

Figure 24:
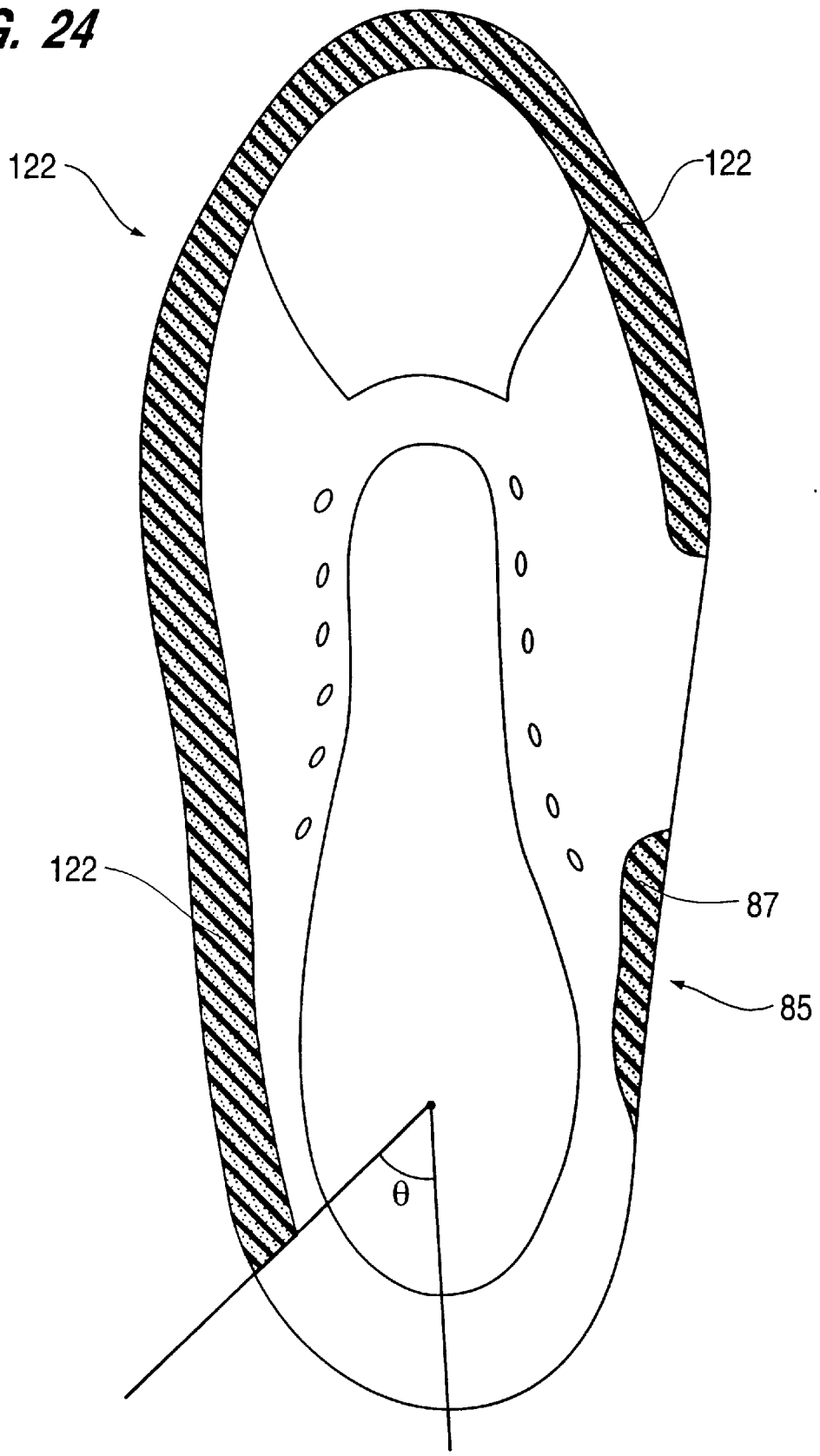
FIG. 24 is a top view of a cross-section taken in the transverse plane of an alternative embodiment of the present invention showing the use of a high density foam material stabilizer.

FIG. 24 is a top view of a cross-section taken in the transverse plane of an article of footwear 85 showing the use of relatively stiff high density foam material stabilizer(s) 122 in the sole 89. Again, the stabilizer could optionally be removed from an anterior most area of the shoe proximate the distal end of the toes of the wearer's foot as discussed above. Further, the high density foam material stabilizer 122 could be used in the lateral midfoot area in order to stabilize inversion or supination of a wearer's foot, as also shown in FIG. 25.

Figure 25:
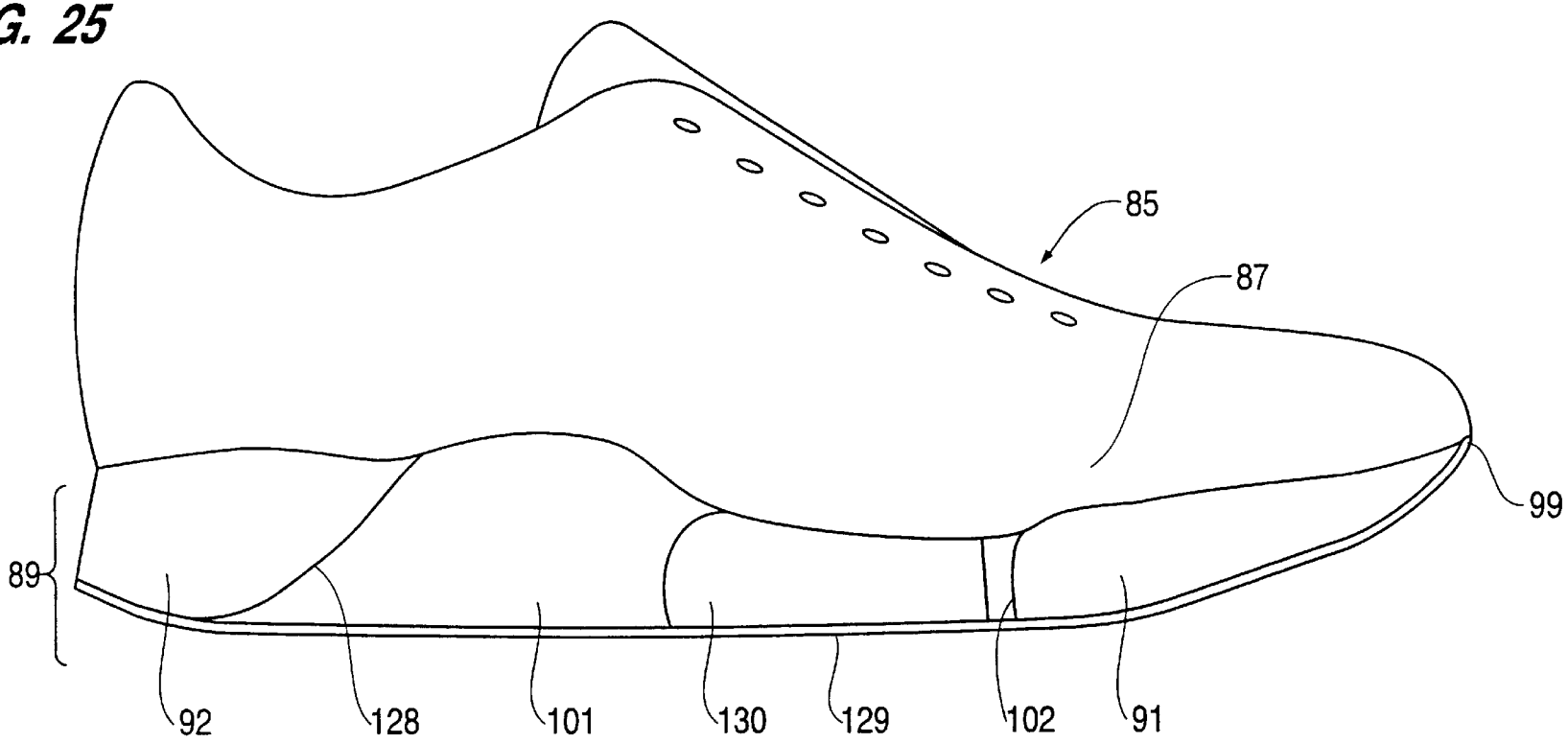
FIG. 25 is a lateral side view of an alternative embodiment of the present invention showing the use of a ramp-shaped stabilizer comprising a high density foam material.

FIG. 25 is a lateral side view of an article of footwear showing the use of a stabilizer, e.g., a high density foam material 122 in the midfoot area, and also anterior to the fifth metatarsal-phalangeal joint. The ramp-shaped stabilizer in the midfoot area progressively increases the stiffness of the sole in such a manner that when loaded by a wearer characterized as a rearfoot striker, the wearer's foot will be guided from an inverted or supinated position observed during the braking phase, toward a more neutral position during the stance phase, thus enhancing stability. Rearfoot strike zone 92 and the lateral side of the sole between the proximal and distal head of the fifth metatarsal could include one or more gas-filled bladders for effecting enhanced cushioning and stability.

Figure 26:
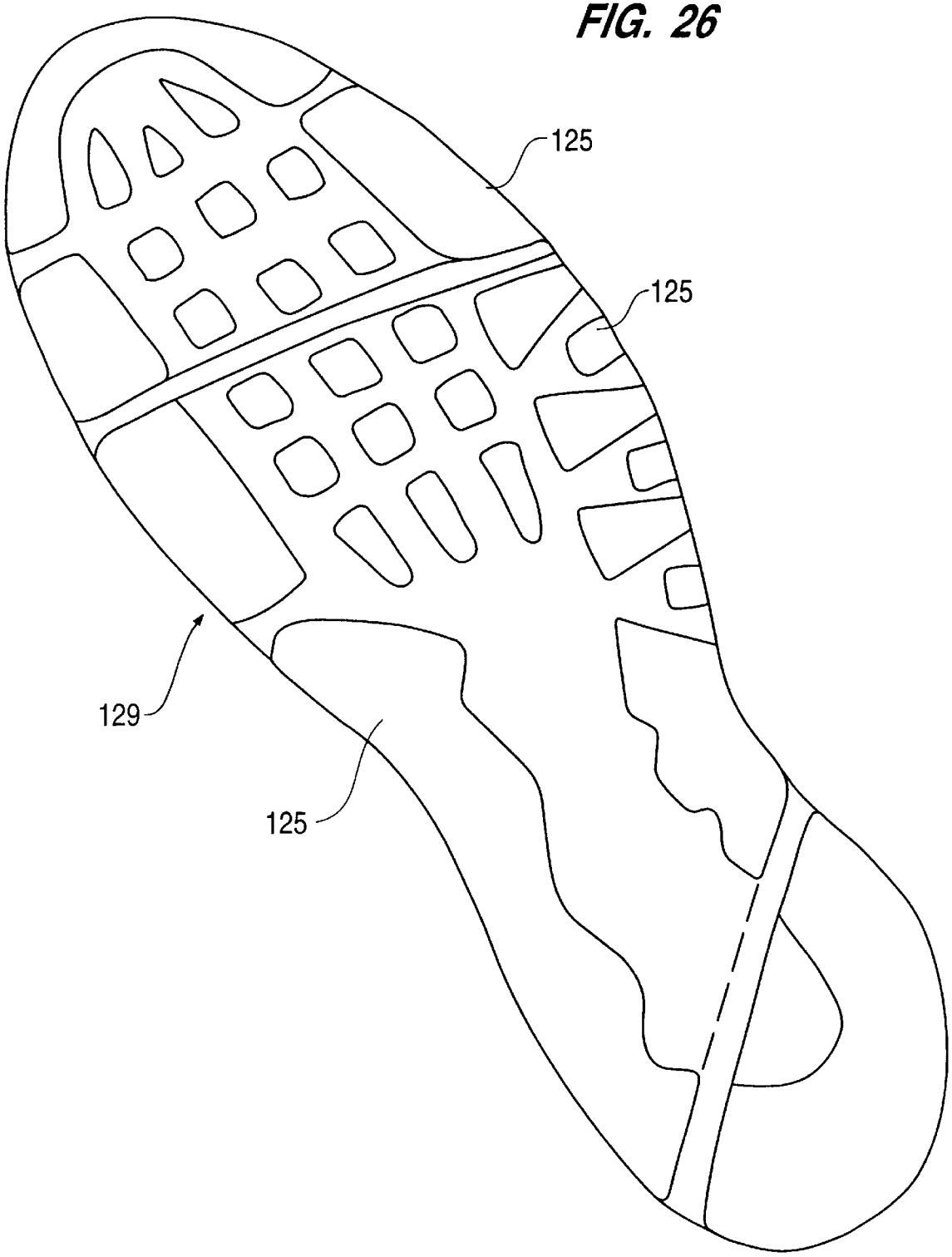
FIG. 26 is a bottom view of the sole of an article of footwear showing the use of lugs or traction members of various select sizes and shapes as stabilizers in an alternate embodiment of the present invention.

FIG. 26 is a bottom view of the sole 89 of an article of footwear 85 showing the use of outsole lugs or traction members 125 of various sizes and configurations as stabilizers in an alternate embodiment of the present invention. Relatively large and/or continuous lugs or traction members are used on the medial side and about the front of the sole proximate but anterior to the overlying position of the fifth metatarsal-phalangeal joint. Small lug or traction members having a reduced bearing area are then used in the area between the proximal and distal heads of the fifth metatarsal.

In the embodiment shown, a more substantial traction member is used underlying the lateral midfoot area in order to better stabilize this area for wearers whom might have a tendency to overly invert or supinate the foot, but such could be replaced by smaller lugs or traction members having a smaller bearing area for individuals not having this tendency. The rearfoot strike zone area comprises a single traction member having a relatively smooth surface. This is done out of consideration for wear, and the desire to avoid sudden catching or snagging of the shoe as the shoe sole 89 slides anteriorly in contact with the support surface during the early portion of the braking phase. In order to counteract the greater stiffening and moderating effect of such a large traction member in the rearfoot strike zone, the stiffness of the overlying midsole should be greatly reduced in this area, e.g., with the use of a lower density foam material, or gas-filled bladder having reduced stiffness in compression. The alternate use of traction members comprising thin ribs having peaks and valleys properly orientated with regards to the sliding action of the shoe during the early portion of the braking phase is also contemplated, and such is known in the prior art.

Figure 27:
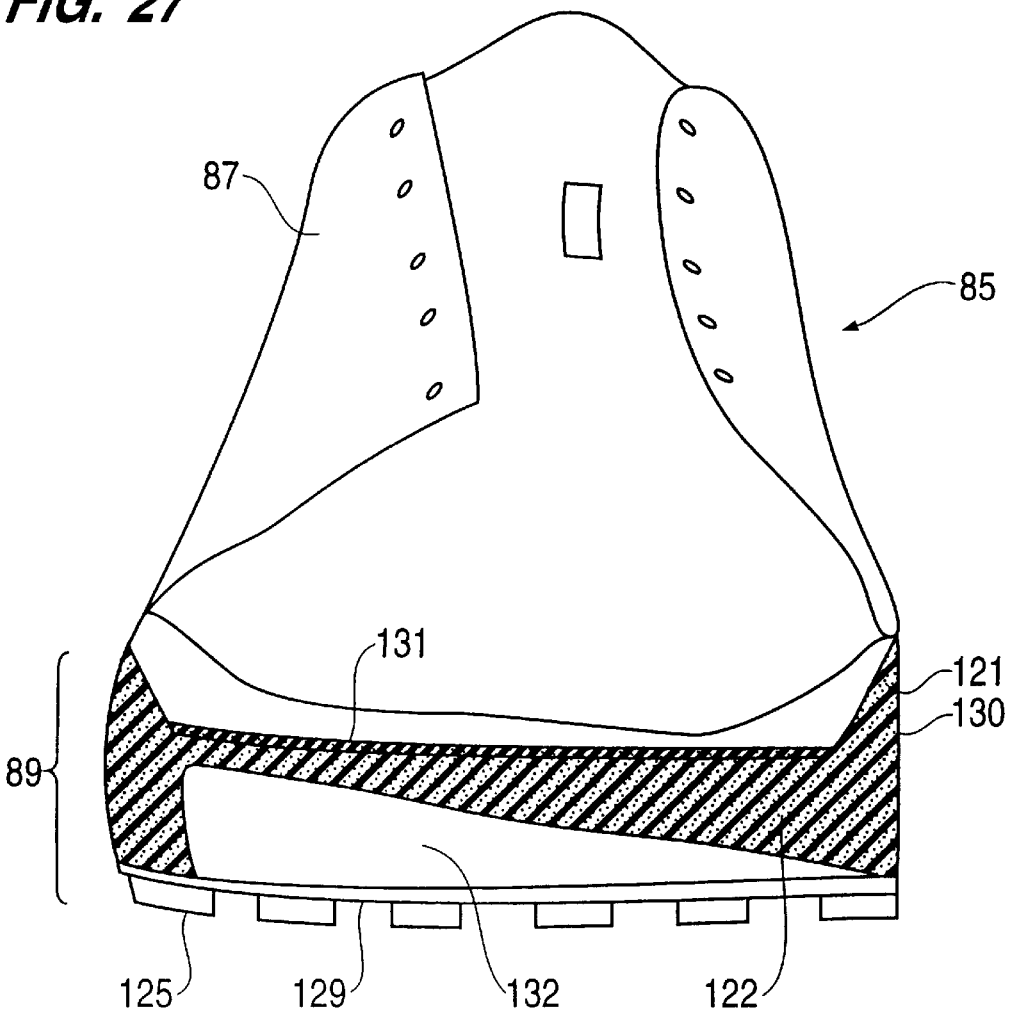
FIG. 27 is a front view of a cross-section of an article of footwear taken along a line consistent with line 27—27 shown in FIG. 13.

Shown in FIG. 27 is the use of a high density foam material stabilizer 122 along the medial and lateral sides of the midsole 130 of an article of footwear 85. In addition, the high density foam material stabilizer 122 has a ramp-shape portion 128 when viewed along the frontal plane being inclined and ascending from the medial to the lateral side. This can be advantageous for individuals who tend to heavily load the medial side of the sole and/or overly evert or inwardly rotate the foot during walking or running. Just the opposite configuration, i.e., a ramp-shaped portion 128 of a high density foam material stabilizer 122 that would be inclined ascending from the lateral towards the medial side could be advantageous for individuals who tend to heavily load and/or invert or outwardly rotate the foot during walking or running. Flat footed individuals tend to exhibit a pronated calcaneus at stance, and a forefoot varus condition, whereas high arched individuals tend to exhibit an inverted calcaneus at stance and often a valgus forefoot. Further, while a gradual transition as between materials exhibiting different stiffness in compression is preferred, the presence of materials having different relative stiffness in compression, regardless of whether the transition or integration of such materials be so gradual as depicted in FIG. 27, can effect like functional results. The high density foam material 122 including the ramp-shaped portion 128 can be formed as a continuous portion and bridge the lateral and medial sides, or be discontinuous, and extend only across a portion of the width of the sole 89 of an article of footwear 85.

The above-discussion concerns the preferred embodiments of the present invention. As discussed above, any form of perimeter stabilizer could be provided along the same perimeter locations as described above for the band-type stabilizers, in place of (or in addition to) the bands. Various other embodiments as well as many changes and alterations may be made without departing from the spirit and broader aspects of the invention as defined in the claims.

I claim:

1. Footwear comprising an upper and a sole, said sole having a longitudinal axis, a front end, a rear end, a lateral side, and a medial side, said sole including at least one stabilizer disposed at least (a) substantially along said medial side between a first point located near the big toe and a second point at a location spaced to the medial side of the longitudinal axis of the sole along a rearfoot area of the sole such that said second point is substantially closer to said rear end than said front end, and (b) substantially along said lateral side between a third point located near the front of the fourth toe and a fourth point located near the fifth metatarsal-phalangeal joint, said sole having at least one first perimeter portion extending rearwardly from said second point and at least around said rear end, and extending rearwardly from said fourth point, said first perimeter portion having lesser stiffness in compression than a perimeter portion of said sole including said at least one stabilizer.

2. Footwear in accordance with claim 1, wherein said second point intersects an imaginary line which extends rearwardly from a nominal plantar weight bearing center of the heel and which forms an angle of about 10° to about 50° with the longitudinal axis of the sole.

3. Footwear in accordance with claim 2, wherein said first point is located near the front of the big toe.

4. Footwear in accordance with claim 3, wherein a second perimeter portion of said sole extends rearwardly from said fourth point along said lateral side to a fifth point located near the proximal head of the fifth metatarsal, said second perimeter portion having a lesser stiffness in compression than said portions of said sole including said at least one stabilizer.

5. Footwear in accordance with claim 4, wherein at least one stabilizer is also disposed substantially along said lateral side between said fifth point and a sixth point located near the junction of the calcaneus and the cuboid.

6. Footwear in accordance with claim 1, wherein said first point is located near the front of the big toe.

7. Footwear in accordance with claim 1, wherein a second perimeter portion of said sole extends rearwardly from said fourth point along said lateral side to a fifth point located near the proximal head of the fifth metatarsal, said second perimeter portion having a lesser stiffness in compression than said portions of said sole including said at least one stabilizer.

8. Footwear in accordance with claim 1, wherein at least one stabilizer is further disposed substantially along said lateral side between a fifth point located near the proximal head of the fifth metatarsal and a sixth point located near the junction of the calcaneus and the cuboid.

9. Footwear in accordance with claim 8, in which said stabilizer comprises a ramp shape.

10. Footwear in accordance with claim 9, in which said stabilizer comprises a high density foam material.

11. Footwear in accordance with claim 1, wherein said at least one stabilizer further extends around said front end between said first point and said third point.

12. Footwear in accordance with claim 11, in which a portion of said stabilizer along said front end has a reduced height as compared to adjacent portions of said stabilizer.

13. Footwear in accordance with claim 1, wherein said fourth point is anterior to the fifth metatarsal-phalangeal joint.

14. Footwear in accordance with claim 1, wherein a first stabilizer extends between said first and second points and a second stabilizer extends between said third and fourth points.

15. Footwear in accordance with claim 1, wherein a perimeter portion of said sole extending around said front end between said first and third points has a lesser relative stiffness than said portions of said sole including said at least one stabilizer.

16. Footwear in accordance with claim 1, in which said sole includes at least one line of flexion which extends to said medial side, and in which a gap is defined in said stabilizer at said line of flexion.

17. Footwear in accordance with claim 1, in which said stabilizer is a thin band.

18. Footwear in accordance with claim 17, in which said thin band is composed of an elastic material.

19. Footwear in accordance with claim 1, in which said stabilizer is an outsole wrap.

20. Footwear in accordance with claim 1, in which said stabilizer is a midsole wrap.

21. Footwear in accordance with claim 1, in which said stabilizer is composed of a high density foam material.

22. Footwear in accordance with claim 21, in which said stabilizer comprises a ramp-shaped portion inclined and ascending from posterior to anterior along the lateral side of the sole.

23. Footwear in accordance with claim 21, in which said stabilizer comprises a ramp-shaped portion inclined and ascending from medial to lateral along the frontal plane.

24. Footwear in accordance with claim 21, in which said stabilizer comprises a ramp-shaped portion inclined and ascending from lateral to medial along the frontal plane.

25. Footwear in accordance with claim 1, in which said stabilizer is a footframe.

26. Footwear in accordance with claim 1, in which a gas-filled bladder is provided in said sole along said first perimeter portion.

27. Footwear in accordance with claim 1, in which said stabilizer is a moderator.

28. Footwear in accordance with claim 27, in which said moderator comprises an arch support.

29. Footwear in accordance with claim 1, in which said stabilizer is a combination footframe and moderator.

30. Footwear in accordance with claim 1, in which said stabilizer is a combination footframe and sidewall stabilizer.

31. Footwear in accordance with claim 1, in which said stabilizer is a combination sidewall stabilizer and moderator.

32. Footwear in accordance with claim 1, in which said stabilizer comprises traction members of select size and shape.

33. Footwear comprising an upper and a sole, said sole having a longitudinal axis, a certain length, a front end, a rear end, a lateral side, and a medial side, said sole including at least one stabilizer disposed at least (a) substantially continuously along said medial side between a first point at a location spaced to the medial side of the longitudinal axis of the side near the front end of the sole and a second point at a location spaced to the medial side of the longitudinal axis of the sole along a rearfoot area of the sole such that said second point is substantially closer to said rear end than said front end, and (b) substantially along said lateral side between a third point at a location spaced to the lateral side of the longitudinal axis of the sole near the front end of the sole and a fourth point spaced rearward of the third point and spaced rearward of the front end a distance no more than about forty percent of the length of the sole, said sole having at least one first perimeter portion extending rearwardly from said second point and at least around said rear end, and extending rearwardly of said fourth point, said first perimeter portion having lesser stiffness in compression than said a perimeter portion of sole including said at least one stabilizer.

34. Footwear in accordance with claim 33, wherein said second point intersects an imaginary line which extends a nominal plantar weight bearing center of the heel and which forms an angle of about 10° to about 50° with the longitudinal axis of the sole.

35. Footwear in accordance with claim 33 wherein said at least one stabilizer extends substantially continuously between said first point and said third point.

36. Footwear in accordance with claim 33 wherein said first perimeter portion extends between said first point and said third point.

37. Footwear in accordance with claim 36 wherein said first and third point are separated by an angle of about forty degrees as measured from an apex located along a transverse line perpendicular to said longitudinal axis which includes said fourth point.

* * * * *